US008855356B1

(12) United States Patent
Price

(10) Patent No.: US 8,855,356 B1
(45) Date of Patent: Oct. 7, 2014

(54) DUAL RING MAGNET APPARATUS

(71) Applicant: Skullcandy, Inc., Park City, UT (US)

(72) Inventor: Rex Price, Saratoga Springs, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 13/719,000

(22) Filed: Dec. 18, 2012

(51) Int. Cl.
*H04R 9/00* (2006.01)
*H04R 9/04* (2006.01)
*H04R 9/02* (2006.01)

(52) U.S. Cl.
CPC ..... *H04R 9/046* (2013.01); *H04R 2209/024* (2013.01); *H04R 9/00* (2013.01); *H04R 9/025* (2013.01); *H04R 2209/022* (2013.01)
USPC ..... 381/421; 381/412; 381/414; 381/420

(58) Field of Classification Search
CPC .. H04R 2209/022; H04R 9/025; H04R 9/046; H04R 9/00; H04R 2209/024
USPC ..... 381/412, 414, 420–421
See application file for complete search history.

(56) References Cited

U.S. PATENT DOCUMENTS 5,729,617 A * 3/1998 Gruber ..... 381/412
5,828,767 A 10/1998 Button
6,768,806 B1 7/2004 Button et al.
7,006,653 B2 * 2/2006 Guenther ..... 381/409
7,146,020 B2 * 12/2006 Peng ..... 381/409
2005/0099255 A1 5/2005 Zhang
2006/0093180 A1 5/2006 Kim
2007/0009133 A1 * 1/2007 Gerkinsmeyer ..... 381/398
2007/0237352 A1 * 10/2007 Andersen et al. ..... 381/414
2008/0025552 A1 * 1/2008 Dohi et al. ..... 381/421
2012/0243722 A1 * 9/2012 Huang ..... 381/371
2013/0266173 A1 * 10/2013 Niedermann ..... 381/400

* cited by examiner

*Primary Examiner* — Curtis Kuntz
*Assistant Examiner* — Ryan Robinson
(74) *Attorney, Agent, or Firm* — Jon-Michael Burbage; Maschoff Brennan

(57) ABSTRACT

An apparatus related to a magnetic circuit design is disclosed. The apparatus includes a magnetic assembly and an electrically-conductive mobile member. The magnetic assembly includes an inner magnet, an outer magnet, an inner cap, an outer cap and a washer. The magnetic assembly is configured to produce a magnetic field having a zone of operation between the inner cap and the outer cap. The zone of operation has substantially uniform magnetic field strength. The zone of operation has magnetic field directions substantially perpendicular to an ideal motion direction. The electrically-conductive mobile member is disposed in the zone of operation of the magnetic field and electrically coupled to a diaphragm of a driver. The electrically-conductive mobile member is configured to move within the zone of operation of the magnetic field in response to the magnetic field when an alternating current is passed through the electrically-conductive mobile member.

19 Claims, 26 Drawing Sheets

DUAL RING MAGNET APPARATUS

BACKGROUND

The specification relates to magnetic circuit design. In particular, the specification relates to magnetic circuit design for a speaker driver. FIGS. 1A through 1J depict a traditional magnetic circuit design for a speaker driver.

FIG. 1A is a cross sectional view 100 illustrating a traditional magnetic circuit design for a speaker driver. A traditional magnetic circuit design for a speaker driver includes a disc or ring-shaped magnet 104, a top plate 102, a traditional voice coil 110 and a yoke 106 as illustrated in FIG. 1A. The top plate 102 is a substantially circular disk-shaped object made of iron or low carbon steel and attached to the top of the magnet 104. The magnet 104 is disposed inside the yoke 106. The yoke 106 is a substantially circular bowl-shaped basket made of iron or low carbon steel. The top plate 102 and the magnet 104 are coupled into the yoke 106. For example, the top plate 102 and the magnet 104 are glued to the yoke 106 using a conventional adhesive. The space between the top plate 102 and the yoke 106 is referred to as a traditional magnet gap 108. The traditional voice coil 110 is coupled to a driver diaphragm and suspended in the traditional magnet gap 108.

The traditional magnetic circuit produces a magnetic field whose magnetic field lines 112*a*, 112*b*, 112*c* are illustrated in FIG. 1A. If an alternating current passes through the traditional voice coil 110, a Lorentz force is generated in response to the alternating current and the magnetic field. The Lorentz force acts on the traditional voice coil 110, causing the traditional voice coil 110 to move through the magnetic field. The direction of the Lorentz force is determined according to the right-hand rule. In other words, the direction of the Lorentz force is perpendicular to both the direction of the current in the traditional voice coil 110 and the direction of the magnetic field (e.g., the direction of the magnetic field lines 112*a*, 112*b*, 112*c* shown in FIG. 1A). Magnetic field lines 112*a*, 112*b*, 112*c* are referred to collectively as magnetic field lines 112.

FIG. 1B is another cross sectional view 120 illustrating a traditional magnetic circuit design for a speaker driver. As illustrated in FIG. 1B, a substantial portion of the magnetic field lines 112 that intersect the traditional voice coil 110 are not orthogonal to the longitudinal axis of the traditional voice coil 110 (e.g., the magnetic field lines 112 substantially deviates from a direction that is orthogonal to the $\vec{z}$ direction as shown by the key in the top right-hand corner of FIG. 1B). This non-orthogonality of the magnetic field lines 112 causes the motion direction of the traditional voice coil 110 to deviate from an intended motion direction such as the $\pm\vec{z}$ direction, resulting in various distortions to the speaker driver as the traditional voice coil 110 moves.

For example, assume that a coil wire 130 wound around a former 132 has a changing current with a direction pointing out of the page (e.g., a direction pointing towards a user viewing the FIG. 1B). According to the right hand rule, a Lorentz force 134 is generated having a direction perpendicular to the direction of the current and the magnetic field line 112A. Because the magnetic field line 112A is not perpendicular to the longitudinal axis of the traditional voice coil 110 (e.g., the magnetic field line 112A is not perpendicular to the $\vec{z}$ direction as shown in FIG. 1B), the direction of the generated Lorentz force 134 deviates from the $\vec{z}$ direction. In other words, the Lorentz force 134 has a desired vertical component ($\vec{z}$ component) parallel to the $\vec{z}$ direction and an undesired horizontal component ($\vec{z}$ component) orthogonal to the $\vec{z}$ direction. This undesired horizontal component of the Lorentz force 134 causes the traditional voice coil 110 to bend and twist as the driver moves, leading to distortion in the driver system. The twisting of the traditional voice coil 110 can also cause the center dome of the driver diaphragm to expand and contract with the voice coil motion, which is referred to as a breathing mode. The breathing mode of the center dome of the driver diaphragm may introduce audible distortion during audio playback.

FIG. 1C is a graphical representation 140 illustrating angle variations of magnetic field lines from intersecting a traditional voice coil 110 at 90 degrees in a traditional magnetic circuit design. The graphical representation 140 is obtained using a conventional headphone driver. For example, FIG. 1C depicts the angle variations of magnetic fields lines from intersecting the traditional voice coil 110 at 90 degrees when the traditional voice coil 110 is stationary (e.g., the traditional voice coil 110 is at its rest position without any movement). FIG. 1C indicates that a substantial portion of the magnetic field lines is not perpendicular to the longitudinal axis of the traditional voice coil 110 when intersecting the traditional voice coil 110. For example, a substantial portion of the magnetic field lines intersects the traditional voice coil 110 at an angle substantially deviated from 90 degrees; this is represented by non-perpendicular region 197A, 197B. As described above, this non-orthogonality of the magnetic field lines causes various distortions such as twisting and bending of the traditional voice coil 110, a breathing mode, audio distortion, etc. Only a small portion of the magnetic field lines intersects the traditional voice coil 110 at an angle substantially perpendicular to the voice coil; this is represented by substantially perpendicular region 199. As a result, the design of FIG. 1C is limited in that the driver must be precisely mounted in the headphone driver housing.

FIG. 1D is a graphical representation 145 illustrating a contour plot of boundaries where the magnetic field lines have a deviation of ±3 degrees from intersecting a traditional voice coil 110 at 90 degrees in a traditional magnetic circuit design. The angle variations depicted in FIG. 1D are obtained from the angle variations depicted in FIG. 1C. Line 146A represents a boundary where the magnetic field lines have a deviation of −3 degrees from intersecting the traditional voice coil 110 at 90 degrees. For example, line 146A represents a boundary where the magnetic field lines intersect the longitudinal axis of the traditional voice coil 110 at 87 degrees. Lines 146B and 146C represent boundaries where the magnetic field lines have a deviation of +3 degrees from intersecting a traditional voice coil 110 at 90 degrees. For example, lines 146B and 146C represent boundaries where the magnetic field lines intersect the longitudinal axis of the traditional voice coil 110 at 93 degrees.

In an area from line 146A to the left of the box 148, the magnetic field lines have a deviation of at least −3 degrees from intersecting the traditional voice coil 110 at 90 degrees. For example, the magnetic field lines in this area intersect the longitudinal axis of the traditional voice coil 110 at an angle less than 87 degrees. In an area from line 146B to the right of the box 148, the magnetic field lines have a deviation of at least +3 degrees from intersecting the traditional voice coil 110 at 90 degrees. For example, the magnetic field lines in this area intersect the longitudinal axis of the traditional voice coil 110 at an angle greater than 93 degrees. In an area from line 146C to the bottom of the box 148, the magnetic field lines have a deviation of at least +3 degrees from intersecting the traditional voice coil 110 at 90 degrees. For example, the magnetic field lines in this area intersect the longitudinal axis of the traditional voice coil 110 at an angle greater than 93 degrees. Thus, FIG. 1D indicates that a substantial portion of the magnetic field interesting the traditional voice coil 110 has a direction deviated by at least ±3 degrees from a direction perpendicular to the longitudinal axis of the traditional voice coil 110.

FIG. 1E is a graphical representation 150 illustrating a contour plot of boundaries where the magnetic field lines have a deviation of ±2 degrees from intersecting a traditional voice coil 110 at 90 degrees in a traditional magnetic circuit design. The angle variations depicted in FIG. 1E are obtained from the angle variations depicted in FIG. 1C. Line 152A represents a boundary where the magnetic field lines have a deviation of −2 degrees from intersecting the traditional voice coil 110 at 90 degrees. For example, line 152A represents a boundary where the magnetic field lines intersect the longitudinal axis of the traditional voice coil 110 at 88 degrees. Lines 152B and 152C represent boundaries where the magnetic field lines have a deviation of +2 degrees from intersecting a traditional voice coil 110 at 90 degrees. For example, lines 152B and 152C represent boundaries where the magnetic field lines intersect the longitudinal axis of the traditional voice coil 110 at 92 degrees.

In an area from line 152A to the left of the box 156, the magnetic field lines have a deviation of at least −2 degrees from intersecting the traditional voice coil 110 at 90 degrees. For example, the magnetic field lines in this area intersect the longitudinal axis of the traditional voice coil 110 at an angle less than 88 degrees. In an area from line 152B to the right of the box 156, the magnetic field lines have a deviation of at least +2 degrees from intersecting the traditional voice coil 110 at 90 degrees. For example, the magnetic field lines in this area intersect the longitudinal axis of the traditional voice coil 110 at an angle greater than 92 degrees. In an area from line 152C to the bottom of the box 156, the magnetic field lines have a deviation of at least +2 degrees from intersecting the traditional voice coil 110 at 90 degrees. For example, the magnetic field lines in this area intersect the longitudinal axis of the traditional voice coil 110 at an angle greater than 92 degrees. Thus, FIG. 1E indicates that a substantial portion of the magnetic field intersecting the traditional voice coil 110 has a direction deviated by at least ±2 degrees from a direction perpendicular to the longitudinal axis of the traditional voice coil 110.

FIG. 1F is a graphical representation 155 illustrating various locations (locations at lines 154A, 154B, 154C, 154 D, 154E and 154F) where the magnitude of the magnetic field is measured. FIG. 1G is a graphical representation 160 illustrating the magnitude of the magnetic field at various locations illustrated by lines 154A, 154B, 154C, 154D, 154E and 154F, respectively. The graphical representation 160 is obtained using a conventional headphone driver. Line 164A depicts the magnitude of the magnetic field at line 154A. Line 164B depicts the magnitude of the magnetic field at line 154B. Line 164C depicts the magnitude of the magnetic field at line 154C. Line 164D depicts the magnitude of the magnetic field at line 154D. Line 164E depicts the magnitude of the magnetic field at line 154E. Line 164F depicts the magnitude of the magnetic field at line 154F.

The variations of the magnitude versus the distance as depicted by lines 164B and 164D indicate that there are substantial magnitude variations across the traditional magnet gap 108 from the top plate 102 to the yoke 106. Furthermore, the magnitude variations among individual lines 164A-164F indicate that there are substantial magnitude variations of the magnetic field intersecting the traditional voice coil 110. These magnitude variations cause unequal Lorentz forces to be generated and acting at different portions of the traditional voice coil 110. The unequal forces incur a torque on the traditional voice coil 110 and therefore expose the driver to rocking modes. The rocking modes occur when one side of the driver diaphragm lifts higher than the other side of the driver diaphragm. The rocking modes may incur audible distortion or a non-preferred frequency response curve for a driver.

The magnitude variations in FIG. 1G indicate the non-uniform magnetic flux density (or, non-uniform strength of the magnetic field) in the traditional magnet gap 108. The non-uniform strength of the magnetic field may exaggerate the voice coil misalignment problem. For example, in the assembly process it is possible that the traditional voice coil 110 is disposed out of its center position due to assembly errors. If the magnetic field close to the top plate 102 is stronger than the magnetic field close to the yoke 106, the voice coil misalignment may cause a first portion of the traditional voice coil 110 close to the top plate 102 to be exposed to a stronger magnetic field than a second portion of the traditional voice coil 110 close to the yoke 106. As a result, different portions of the traditional voice coil 110 are subjected to unequal forces because of the non-uniform strength of the magnetic field, which incurs undesirable rocking modes for the driver as described above.

FIGS. 1H-1J are graphical representations 170, 180, 185 illustrating the force acting on a traditional voice coil 110 in different sample times (0.000000 second, 0.000375 second, 0.001625 second) for a traditional magnetic circuit design. The graphical representations 170, 180 and 185 are obtained using a conventional driver. FIGS. 1H-1J indicate that the direction of the forces 172, 182, 187 acting on the traditional voice coil 110 substantially deviate from an intended motion direction of the traditional voice coil 110 (e.g., the direction of the forces 172, 182, 187 substantially deviate from a direction parallel with the longitudinal axis of the traditional voice coil 110), which causes various distortions in the driver as described above.

Generally, a traditional voice coil 110 in a traditional magnetic circuit design is coupled to a driver diaphragm using an adhesive and extends above the traditional magnet gap 108 as shown in FIGS. 1A, 1C-1F and 1H-1J. This overhung design approach exposes the upper portion of the traditional voice coil 110 to the stray magnetic field lines above the traditional magnet gap 108. Meanwhile, the lower portion of the traditional voice coil 110 is disposed in the traditional magnet gap 108, and exposed to a different magnetic field strength than the upper portion of the traditional voice coil 110. Thus, the traditional voice coil 110 is subjected to different magnetic field strength as a function of the voice coil position. This varying field strength interacting with the traditional voice coil 110 leads to compression in the voice coil motion, causing additional audio distortions.

SUMMARY

The specification overcomes deficiencies and limitations of the prior art at least in part by providing an apparatus related to a magnetic circuit design. The apparatus may include a magnetic assembly and an electrically-conductive mobile member. The magnetic assembly may include an inner magnet, an outer magnet, an inner cap, an outer cap and a washer. The magnetic assembly may be configured to produce a magnetic field having a zone of operation between the inner cap and the outer cap. The zone of operation may have a substantially uniform magnetic field strength. The zone of operation may have magnetic field directions substantially perpendicular to an ideal motion direction. The electrically-conductive mobile member is disposed in the zone of operation of the magnetic field and mechanically coupled to a diaphragm of a driver. The electrically-conductive mobile member is configured to move within the zone of operation of the magnetic field in response to the magnetic field when an alternating current is passed through the electrically-conductive mobile member.

The present disclosure is particularly advantageous in numerous respects. First, the apparatus may include a magnetic assembly that produces a magnetic field having substantially uniform magnitude in a zone of operation. Second, the direction of the magnetic field in the zone of operation may be substantially perpendicular to an ideal motion direction of a voice coil. Third, the apparatus may include a voice coil that has more layers and/or a shorter height than a traditional voice coil, enabling the voice coil to be immersed in a substantially uniform magnetic field in the excursion range and be more resistant to problems introduced by voice coil misalignment. Other advantages of the apparatus are possible.

BRIEF DESCRIPTION OF THE DRAWINGS

The specification is illustrated by way of example, and not by way of limitation in the figures of the accompanying drawings in which like reference numerals are used to refer to similar elements.

DETAILED DESCRIPTION

An apparatus including a magnetic assembly is described below. In the following description, for purposes of explanation, numerous specific details are set forth in order to provide a thorough understanding of the specification. It will be apparent, however, to one skilled in the art that the embodiments can be practiced without these specific details. In other instances, structures and devices are shown in block diagram form in order to avoid obscuring the specification. For example, the specification is described in one embodiment below with reference to particular hardware. However, the description applies to any type of speaker drivers.

Reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

It should be borne in mind, however, that all of these and similar terms are to be associated with the appropriate physical quantities and are merely convenient labels applied to these quantities. The specification also relates to an apparatus for implementing the disclosure described herein. For example, this apparatus may be specially constructed for the required purposes.

The present disclosure can be applied to all sizes and types of linear magnetic actuators, both audio and non-audio. This includes the full range of audio transduction devices: tweeter; midrange; woofer; headphone; earbuds; and microphone, etc. The present disclosure is also applicable to non-standard audio transducers that utilize current-carrying wires disposed in magnetic gaps. The present disclosure may also be applied in any other magnetic circuit design. An example of a non-audio linear actuator includes a permanent-magnet synchronous motor. A person having ordinary skill in the art will appreciate that there are other non-audio linear actuators.

Overview

Figure 1A:
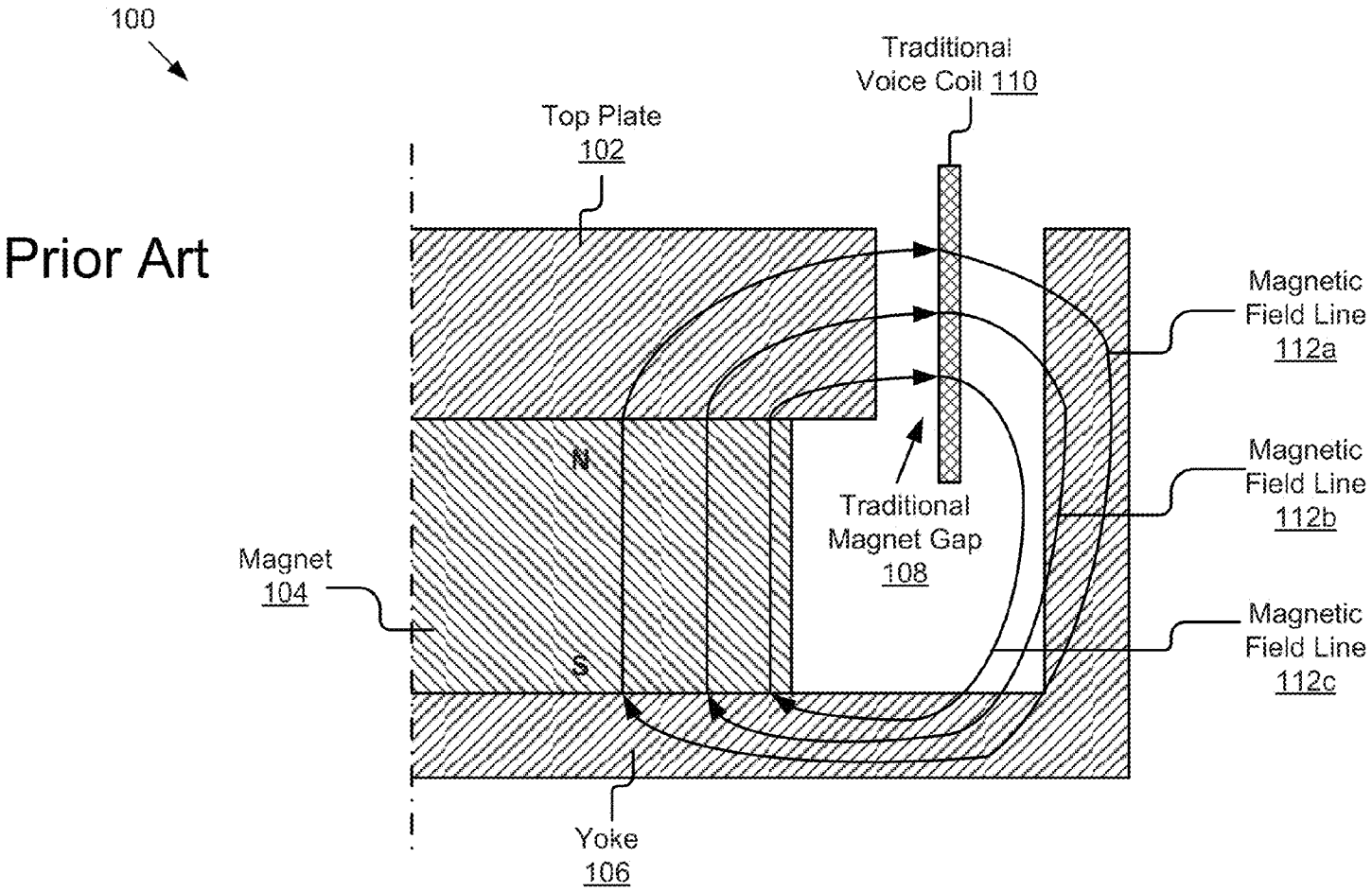
Prior Art Figure 1A
FIGS. 1A and 1B are cross sectional views illustrating a traditional magnetic circuit design for a speaker driver in prior art.
Figure 1B:
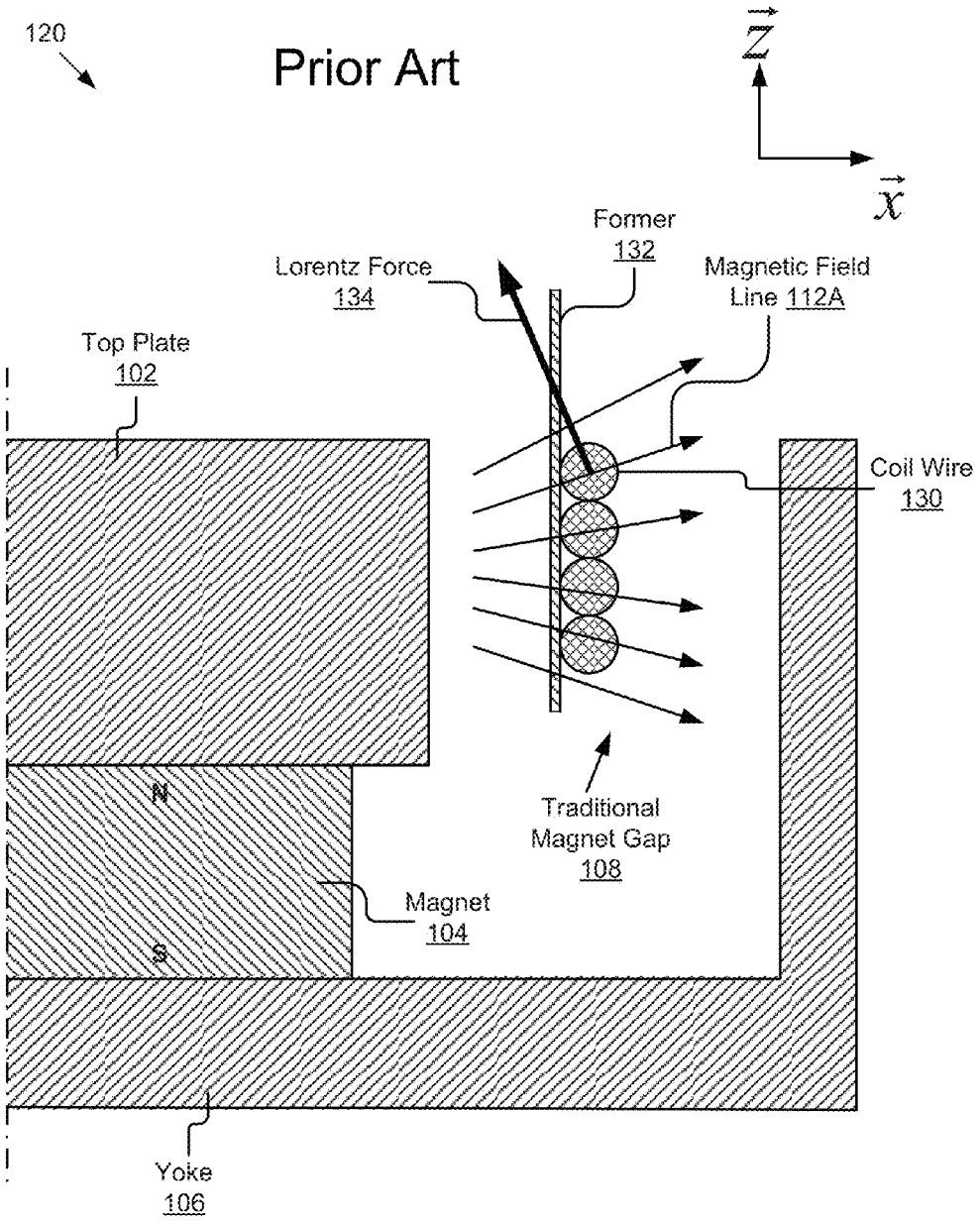
Figure 1C:
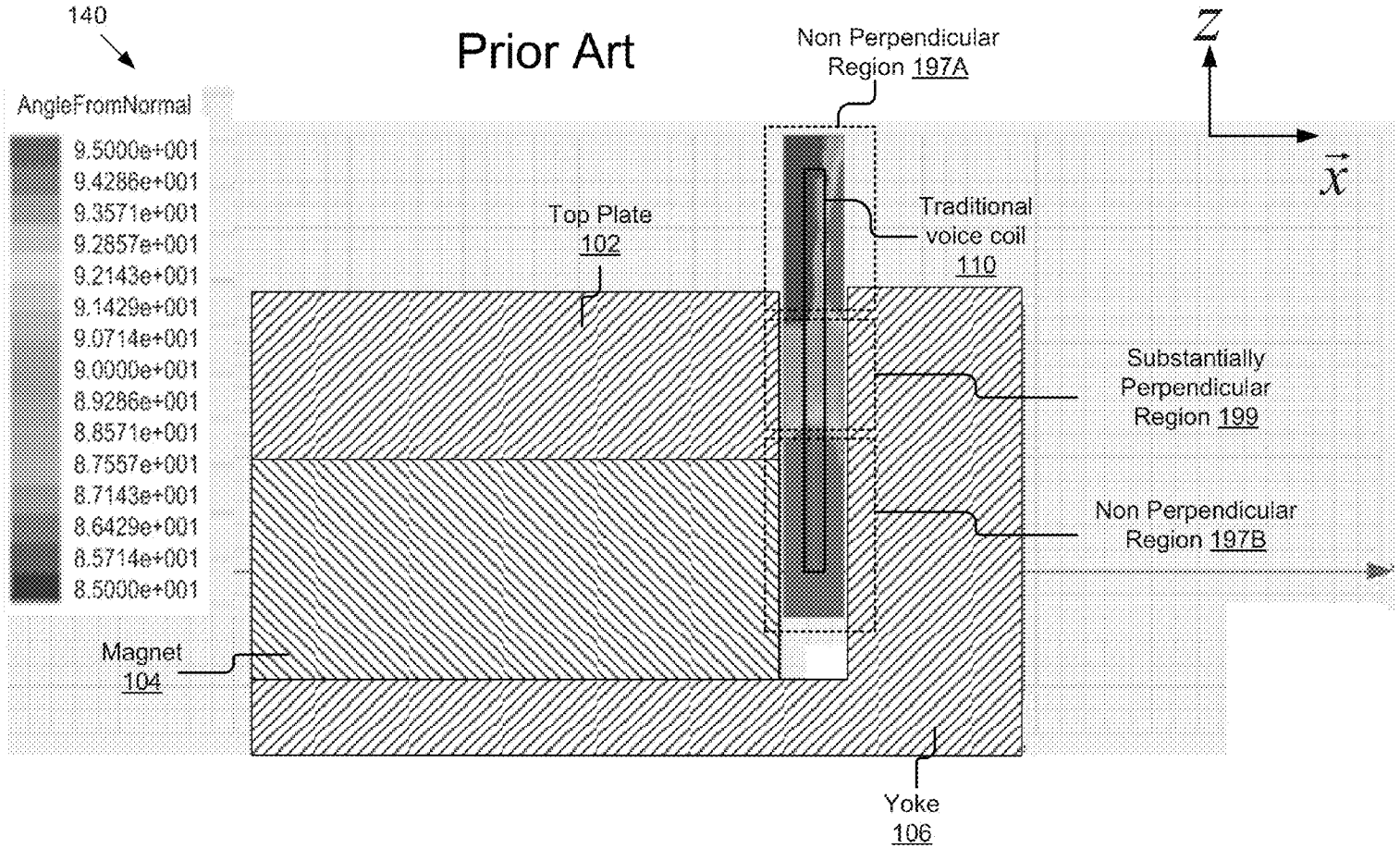
FIG. 1C is a graphical representation illustrating angle variations of magnetic field lines from intersecting a traditional voice coil at 90 degrees in a traditional magnetic circuit design in prior art.
Figure 1D:
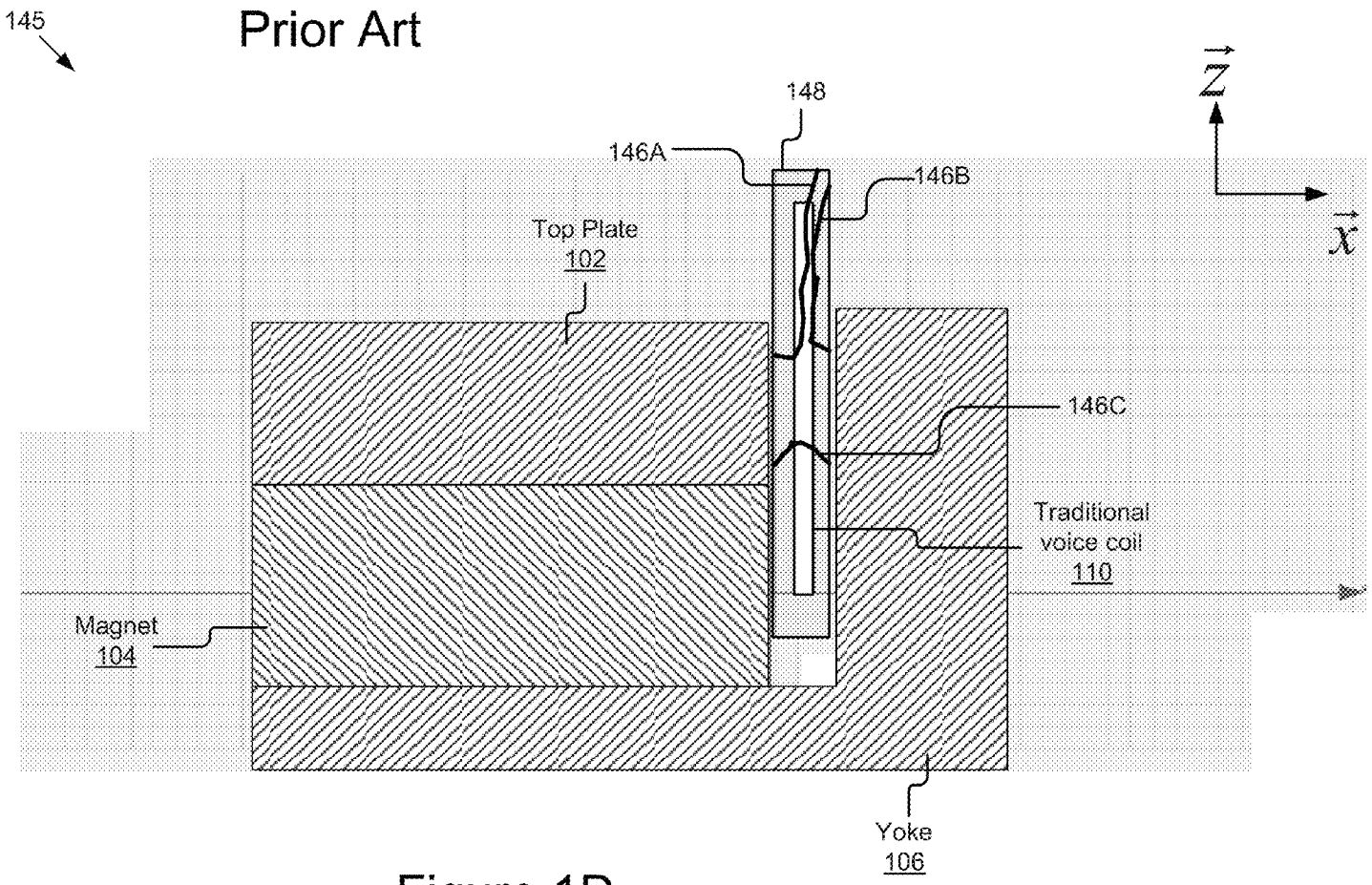
FIG. 1D is a graphical representation illustrating a contour plot of boundaries where the direction of the magnetic field has a deviation of ±3 degrees from a direction perpendicular to a longitudinal axis of a traditional voice coil in a traditional magnetic circuit design in prior art.
Figure 1E:
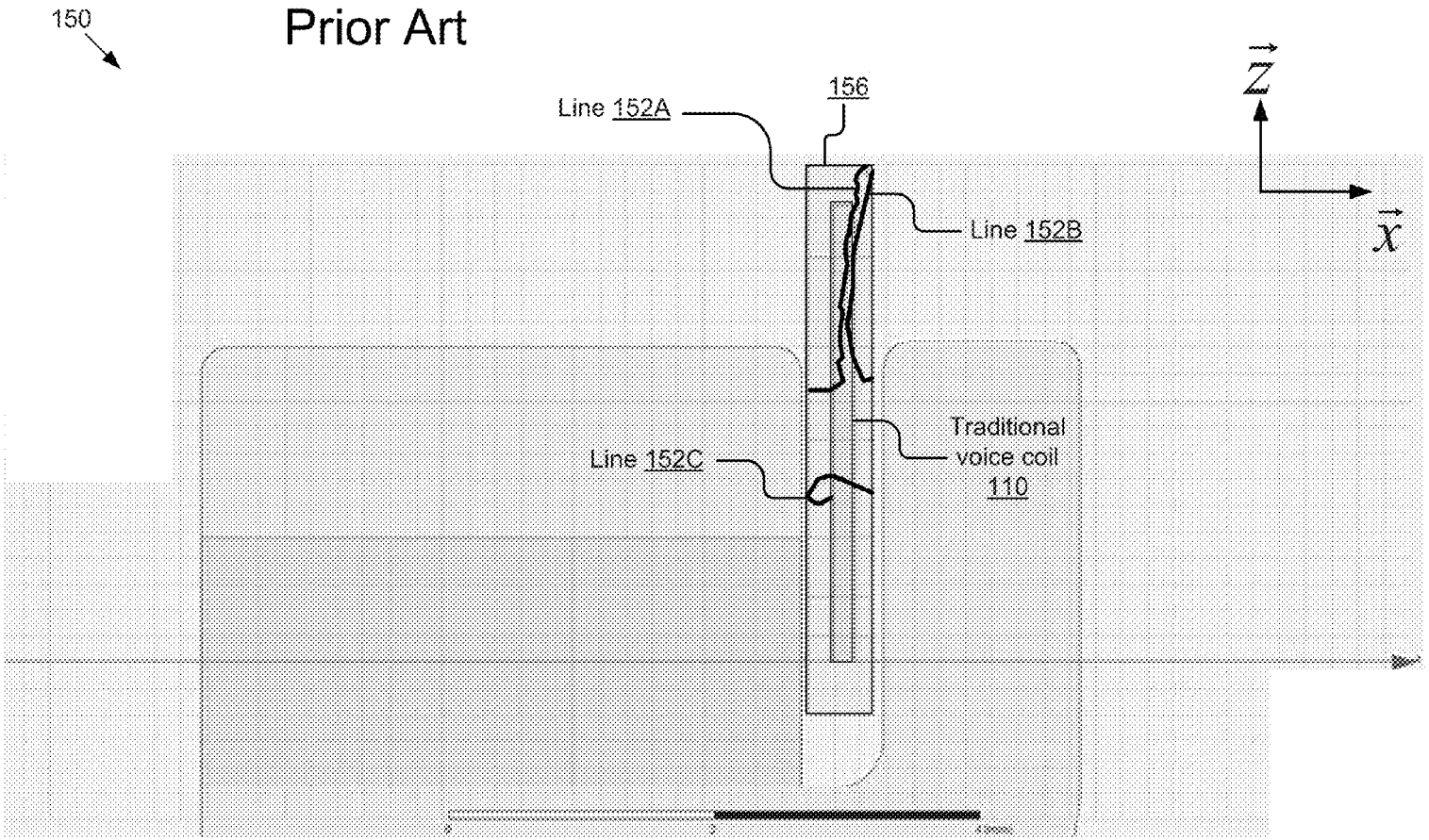
FIG. 1E is a graphical representation illustrating a contour plot of boundaries where the direction of the magnetic field has a deviation of ±2 degrees from a direction perpendicular to a longitudinal axis of a traditional voice coil in a traditional magnetic circuit design in prior art.
Figure 1F:
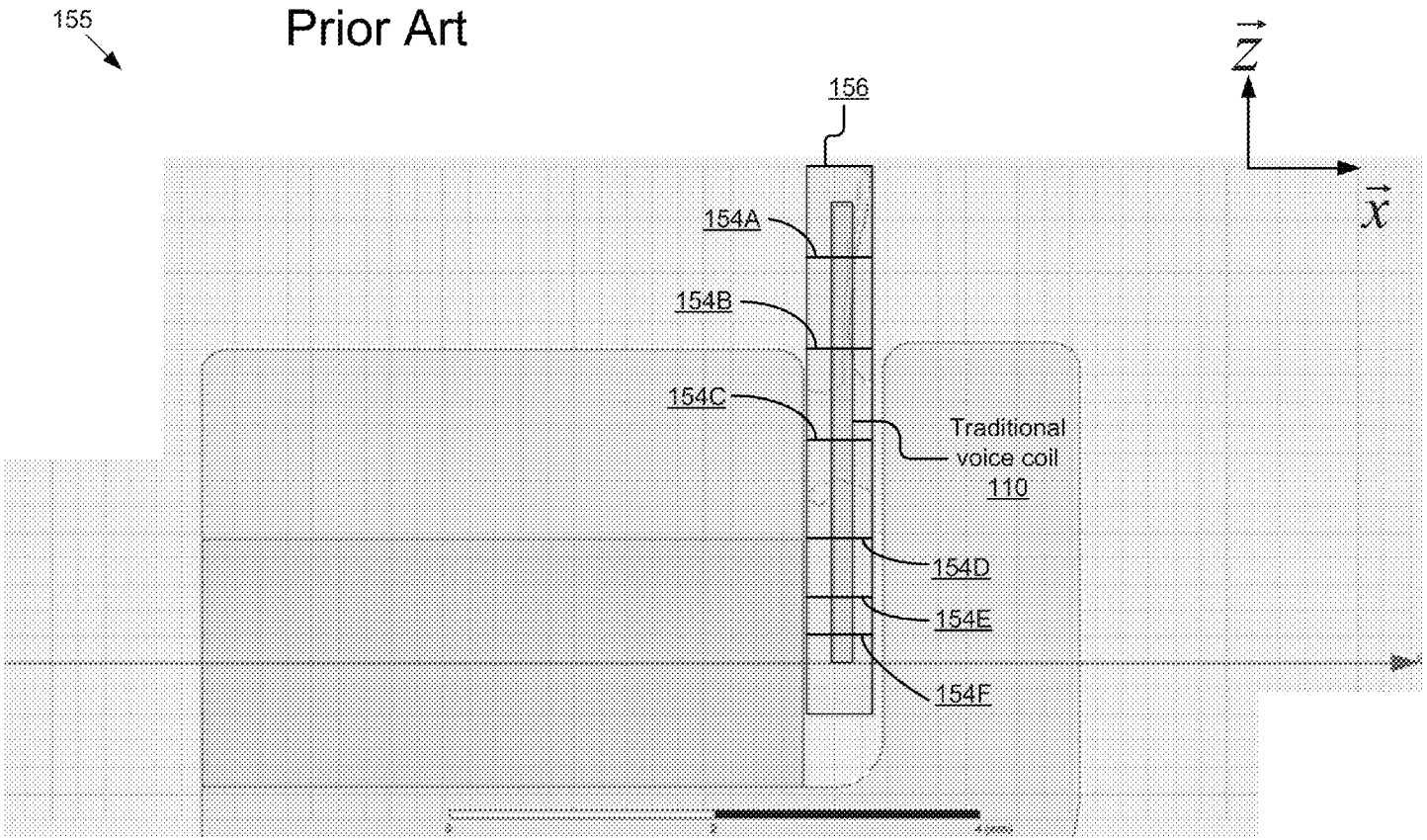
FIG. 1F is a graphical representation illustrating various locations where the magnitude of the magnetic field produced by a traditional magnetic circuit in prior art is measured.
Figure 1G:
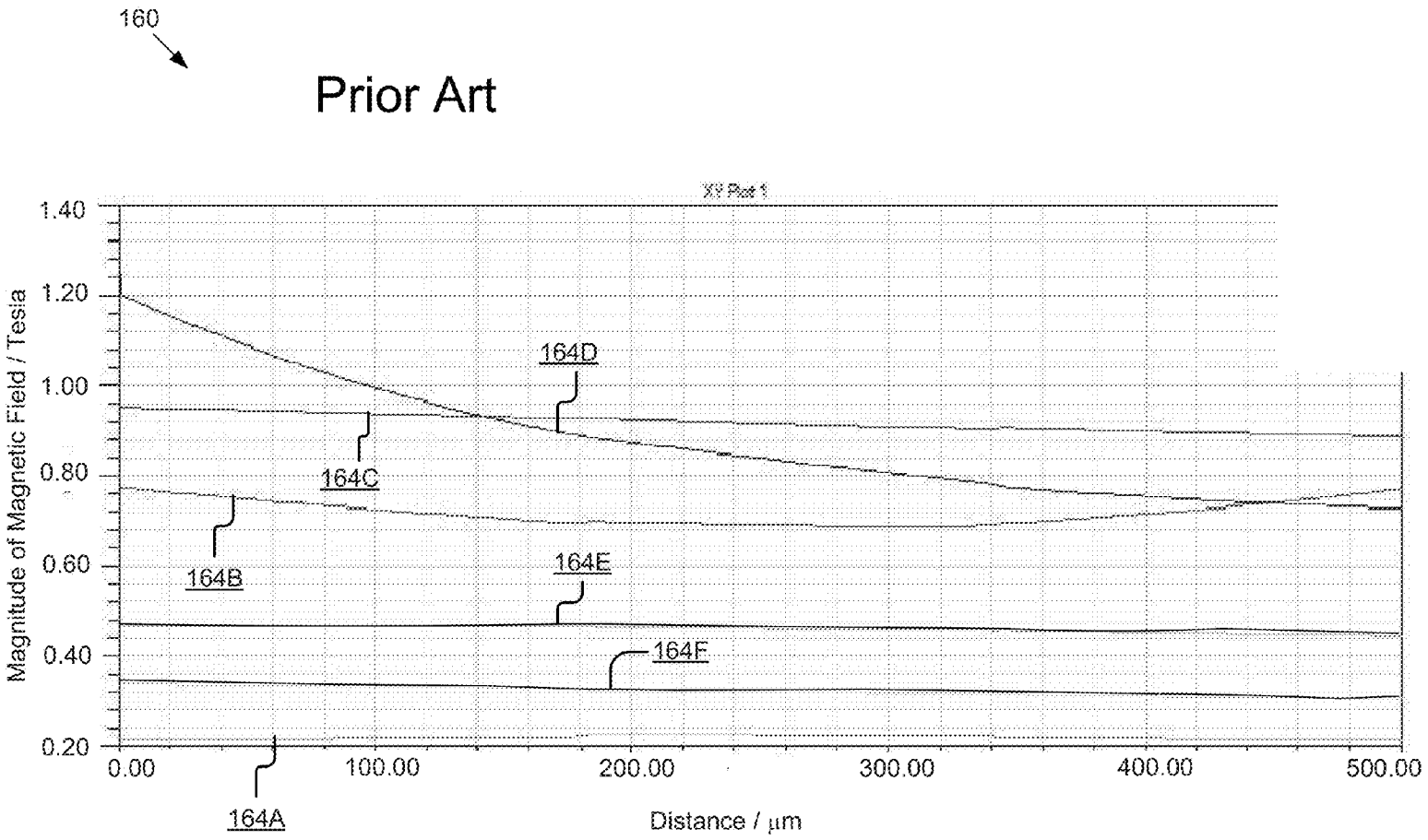
FIG. 1G is a graphical representation illustrating magnitude of magnetic field in various locations of a traditional magnet gap of a traditional magnetic circuit design in prior art.
Figure 1H:
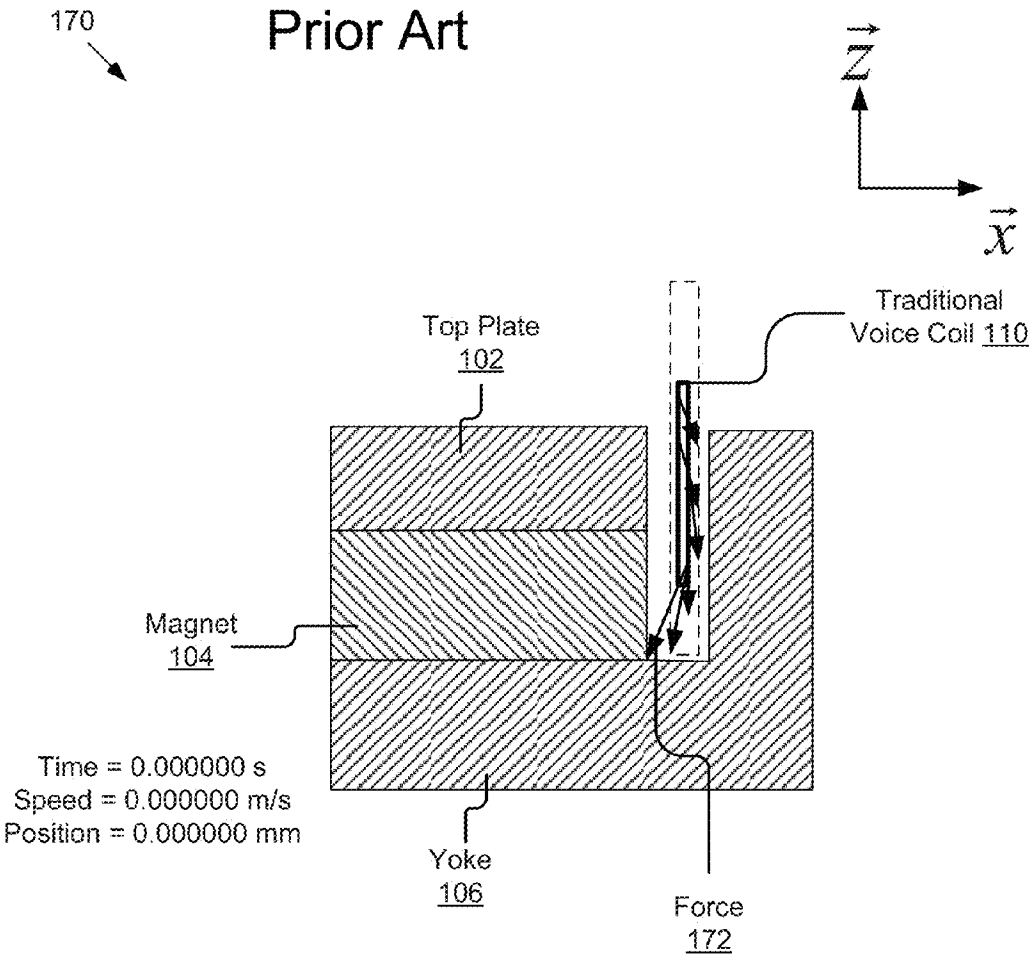
FIGS. 1H-1J are graphical representations illustrating the force acting on a traditional voice coil in different sample times for a traditional magnetic circuit design in prior art.
Figure 1I:
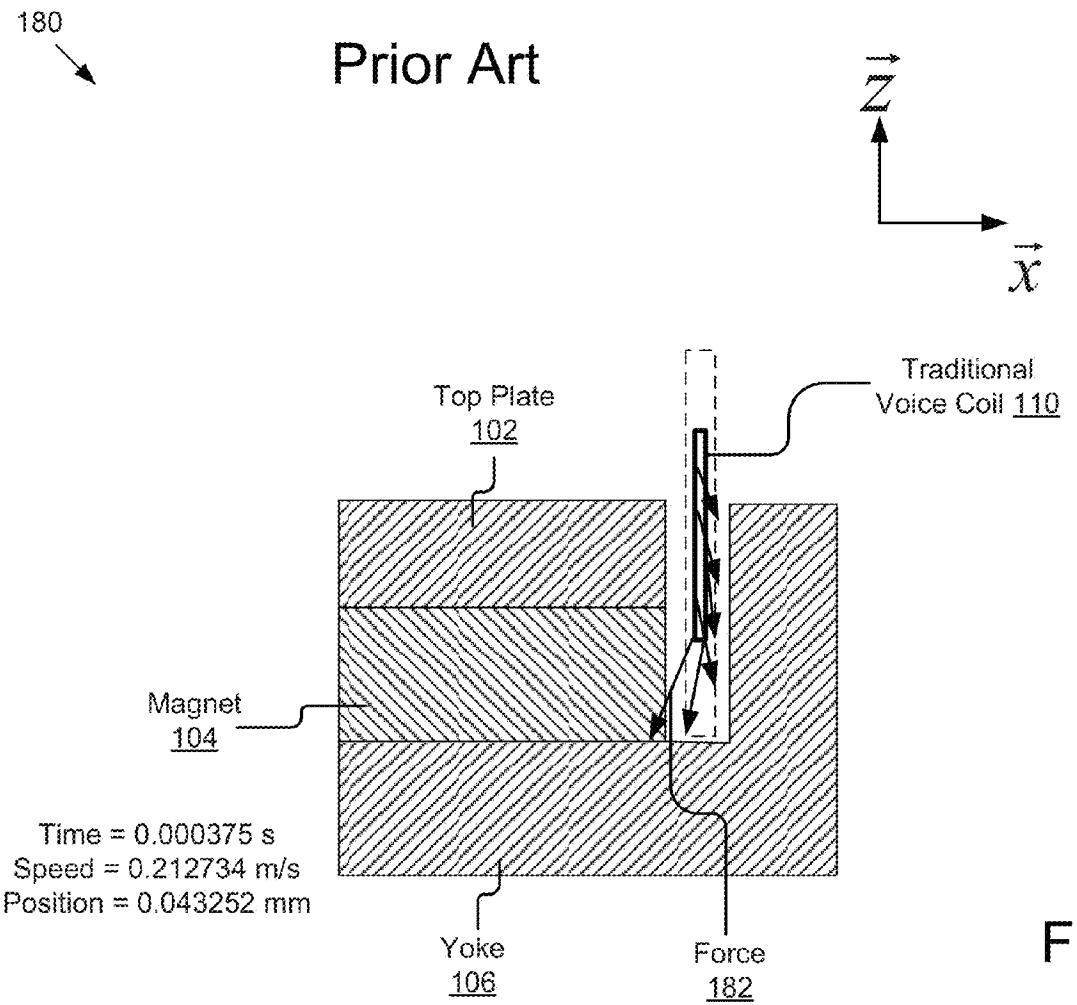
Figure 1J:
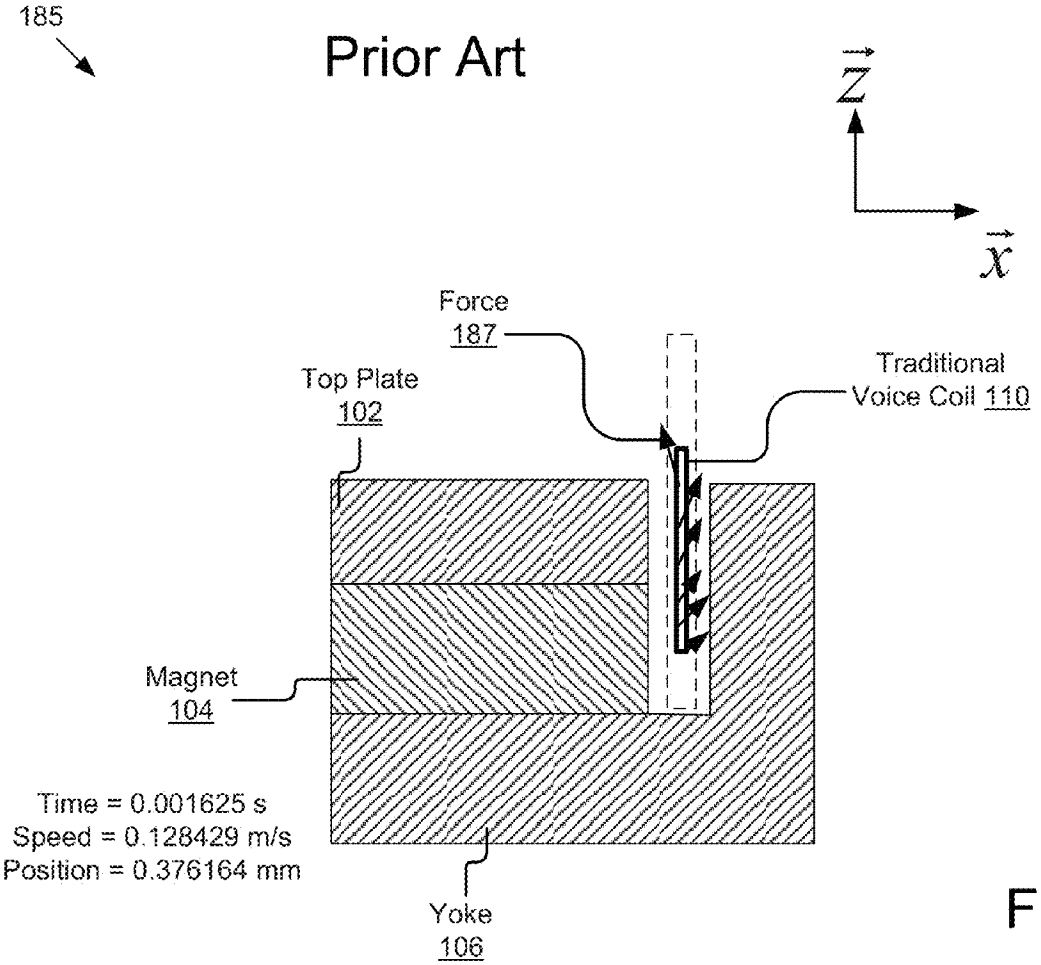
Figure 2:
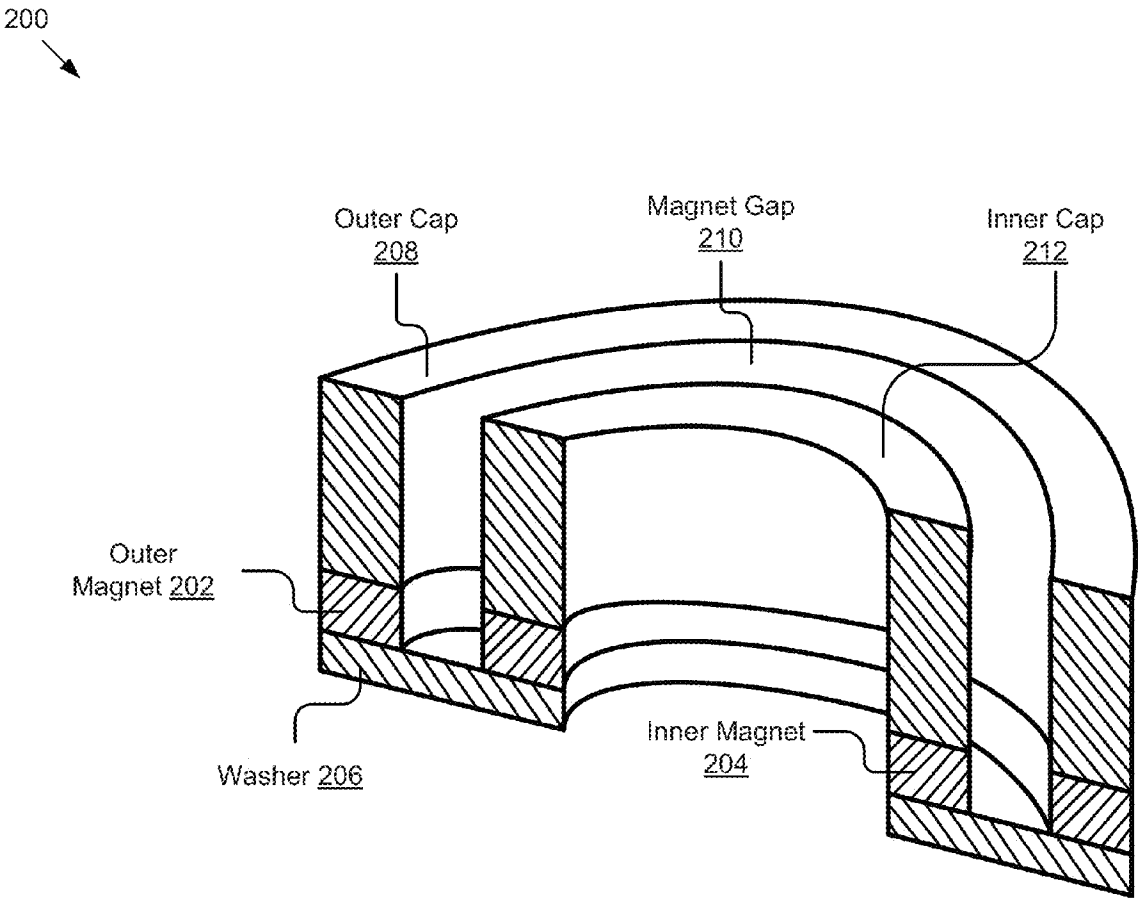
FIG. 2 is a cross sectional view illustrating an apparatus that includes a magnetic assembly according to one embodiment.

FIG. 2 illustrates a cross sectional view of an apparatus 200 including a magnetic assembly according to one embodiment. The magnetic assembly includes one or more of an outer magnet 202, an inner magnet 204, a washer 206, an outer cap 208 and an inner cap 212. The space between the outer cap 208 and the inner cap 212 is referred to as a magnet gap 210. In some embodiments, the apparatus 200 also includes an electrically-conductive mobile member disposed in the magnet gap 210. For example, the electrically-conductive mobile member is a voice coil 304, which is described below in more detail with reference to FIGS. 3A-4. In one embodiment, the outer magnet 202 and the inner magnet 204 are mounted on top of the washer 206. For example, the outer magnet 202 and the inner magnet 204 are disposed concentrically on top of the washer 206. The outer cap 208 is mounted on top of the outer magnet 202. The inner cap 212 is mounted on top of the inner magnet 204.

The outer magnet 202 is a device capable of producing a magnetic field. For example, the outer magnet 202 is a permanent magnet made from a material that is magnetized and capable of creating a persistent magnetic field. In one embodiment, the outer magnet 202 is a ring-shaped magnet. For example, the outer magnet 202 is a ring magnet having an outer diameter of 21.2 millimeters (mm), an inner diameter of 17.2 mm and a height of 2.0 mm. In other examples, the outer magnet 202 may have other dimensions such as a different outer diameter, a different inner diameter and/or a different height. In one embodiment, the outer magnet 202 is a ring magnet having an outer diameter of 0.1 mm to 100 mm, an inner diameter of 0.1 mm to 100 mm and a height of 0.1 mm to 100 mm. In some embodiments, the outer magnet 202 is a ring magnet having an outer diameter of less than or greater than 21.2 mm, an inner diameter of less than or greater than 17.2 mm and a height of less than or greater than 2.0 mm.

In other embodiments, the outer magnet 202 is a magnet having other shapes such as a square shape. In one embodiment, the outer magnet 202 is a neodymium magnet (NdFe35). In another embodiment, the outer magnet 202 is a magnet made of other materials such as Ceramic 8D, ferrite, etc. In some embodiments, the unit of the dimensions described herein can be inch, foot, meter, centimeter, millimeter, nanometer, etc.

The inner magnet 204 is a device capable of producing a magnetic field. For example, the inner magnet 204 is a permanent magnet made from a material that is magnetized and capable of creating a persistent magnetic field. In one embodiment, the inner magnet 204 is a ring-shaped magnet. For example, the inner magnet 204 is a ring magnet having an outer diameter of 14.8 mm, an inner diameter of 10.8 mm and a height of 2.0 mm. In other examples, the inner magnet 204 may have other dimensions such as a different outer diameter, a different inner diameter and/or a different height. In one embodiment, the inner magnet 204 is a ring magnet having an outer diameter of 0.1 mm to 100 mm, an inner diameter of 0.1 mm to 100 mm and a height of 0.1 mm to 100 mm. In some embodiments, the inner magnet 204 is a ring magnet having an outer diameter of less than or greater than 14.8 mm, an inner diameter of less than or greater than 10.8 mm and a height of less than or greater than 2.0 mm. In another embodiment, the inner magnet 204 is a disc-shaped magnet. For example, the inner magnet 204 is a disc magnet having a diameter of 14.8 mm and a height of 2.0 mm. In other examples, the inner magnet 204 may have other dimensions such as a diameter of 0.1 mm to 100 mm and/or a height of 0.1 mm to 100 mm.

In other embodiments, the outer magnet 202 is a magnet having other shapes such as a square shape. In one embodiment, the inner magnet 204 is a neodymium magnet (NdFe35). In another embodiment, the inner magnet 204 is a magnet made of other materials such as Ceramic 8D, ferrite, etc.

In one embodiment, the outer magnet 202 and the inner magnet 204 are made of the same magnetized material and have the same shape. For example, the outer magnet 202 and the inner magnet 204 are both made of neodymium (NdFe35) and the outer magnet 202 and the inner magnet 204 are both ring shape. In another embodiment, the outer magnet 202 and the inner magnet 204 are made of different magnetized materials and/or have different shapes. In one embodiment, the outer diameter of the inner magnet 202 is smaller than the inner diameter of the outer magnet 204. In one embodiment, the outer magnet 202 and the inner magnet 204 have the same height. In another embodiment, the outer magnet 202 and the inner magnet 204 have different heights.

In one embodiment, the magnet volumes for the inner magnet 204 and the outer magnet 202 are 321.7 $mm^3$ and 482.5 $mm^3$ respectively. In another embodiment, the magnet volumes for the inner magnet 204 and the outer magnet 202 has a total of 804.2 $mm^3$, which is only about 30% of the magnetized material utilized in a traditional magnetic circuit design.

The outer cap 208 is a device that facilitates concentration of the magnetic field. In one embodiment, the outer cap 208 is ring-shaped. For example, the outer cap 208 is a ring of low-carbon steel having an outer diameter of 21.2 mm, an inner diameter of 17.2 mm and a height of 3.8 mm. In other examples, the outer cap 208 may have other dimensions with a different outer diameter, a different inner diameter and a different height. In one embodiment, the outer cap 208 is a ring having an outer diameter of 0.1 mm to 100 mm, an inner diameter of 0.1 mm to 100 mm and a height of 0.1 mm to 100 mm. In some embodiments, the outer cap 208 is a ring of low-carbon steel having an outer diameter of less than or greater than 21.2 mm, an inner diameter of less than or greater than 17.2 mm and a height of less than or greater than 3.8 mm.

The outer cap 208 may have other shapes such as a rectangular shape, and can be made of other materials such as iron. In one embodiment, the outer cap 208 has the same outer diameter and the same inner diameter as the outer magnet 202.

The inner cap 212 is a device that facilitates concentration of the magnetic field. In one embodiment, the inner cap 212 is ring-shaped. For example, the inner cap 212 is a ring of low-carbon steel having an outer diameter of 14.8 mm, an inner diameter of 10.8 mm and a height of 3.8 mm. In one embodiment, the inner cap 212 has an outer diameter of 0.1 mm to 100 mm, an inner diameter of 0.1 mm to 100 mm and a height of 0.1 mm to 100 mm. In some embodiments, the inner cap 212 is a ring of low-carbon steel having an outer diameter of less than or greater than 14.8 mm, an inner diameter of less than or greater than 10.8 mm and a height of less than or greater than 3.8 mm.

In other examples, the inner cap 212 may have other dimensions (e.g., a different outer diameter, a different inner diameter and/or a different height, etc.) and other shapes such as a rectangular shape, and can be made of other materials such as iron. In one embodiment, the inner cap 212 has the same outer diameter and the same inner diameter as the inner magnet 204. In another embodiment, the inner cap 212 has a disc shape. For example, the inner cap 212 is a disc having a diameter of 14.8 mm and a height of 3.8 mm. In other examples, the inner cap 212 may have other dimensions such as a diameter of 0.1 mm to 100 mm and/or a height of 0.1 mm to 100 mm.

In one embodiment, the outer cap 208 and the inner cap 212 are made of the same material such as low-carbon steel or iron, and/or have the same shape such as a ring shape. In another embodiment, the outer cap 208 and the inner cap 212 are made of different materials and/or have different shapes. In one embodiment, the outer cap 208 and the inner cap 212 have the same height. In another embodiment, the outer cap 208 and the inner cap 212 have different heights. In one embodiment, the outer cap 208 and the inner cap 212 are designed to provide a magnetically permeable path to concentrate the magnetic flux inside the magnet gap 210.

The washer 206 is a device that facilitates concentration of the magnetic field. In one embodiment, the washer 206 is ring-shaped. For example, the washer 206 is a ring of low-carbon steel having an outer diameter of 21.2 mm, an inner diameter of 10.8 mm and a height of 1.0 mm. In one embodiment, the washer 206 is a ring having an outer diameter of 0.1 mm to 100 mm, an inner diameter of 0.1 mm to 100 mm and a height of 0.1 mm to 100 mm. In another embodiment the washer 206 is a ring of low-carbon steel having an outer diameter of less than or greater than 21.2 mm, an inner diameter of less than or greater than 10.8 mm and a height of less than or greater than 1.0 mm In other examples, the washer 206 may have other dimensions (e.g., a different outer diameter, a different inner diameter and/or a different height, etc.) and other shapes such as a rectangular shape, and can be made of other materials such as iron. In one embodiment, the washer 206 has the same outer diameter as the outer magnet 202 and the same inner diameter as the inner magnet 204. In one embodiment, the washer 206 is made of the same material and/or has the same shape as the outer cap 208 and/or the inner cap 212. In another embodiment, the washer 206 is made of a different material and/or has a different shape from the outer cap 208 and/or the inner cap 212. In yet another embodiment, the washer 206 has a disc shape. For example, the washer 206 is a disc having a diameter of 21.2 mm and a height of 1.0 mm. In other examples, the washer 206 may have other dimensions such as a diameter of 0.1 mm to 100 mm and/or a height of 0.1 mm to 100 mm.

Figure 3A:
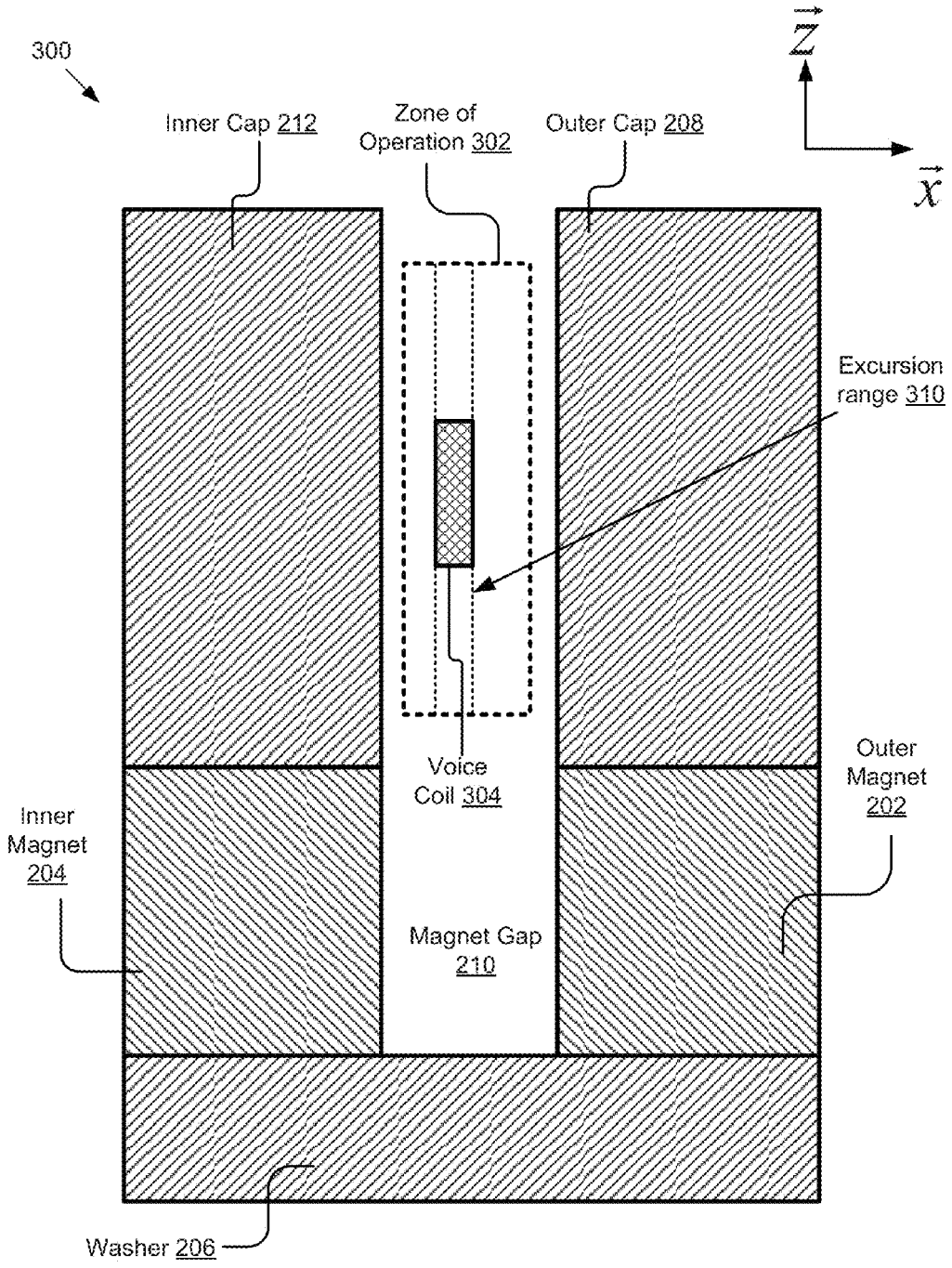
FIGS. 3A-3C are other cross sectional views illustrating an apparatus that includes a magnetic assembly according to various embodiments.
Figure 3B:
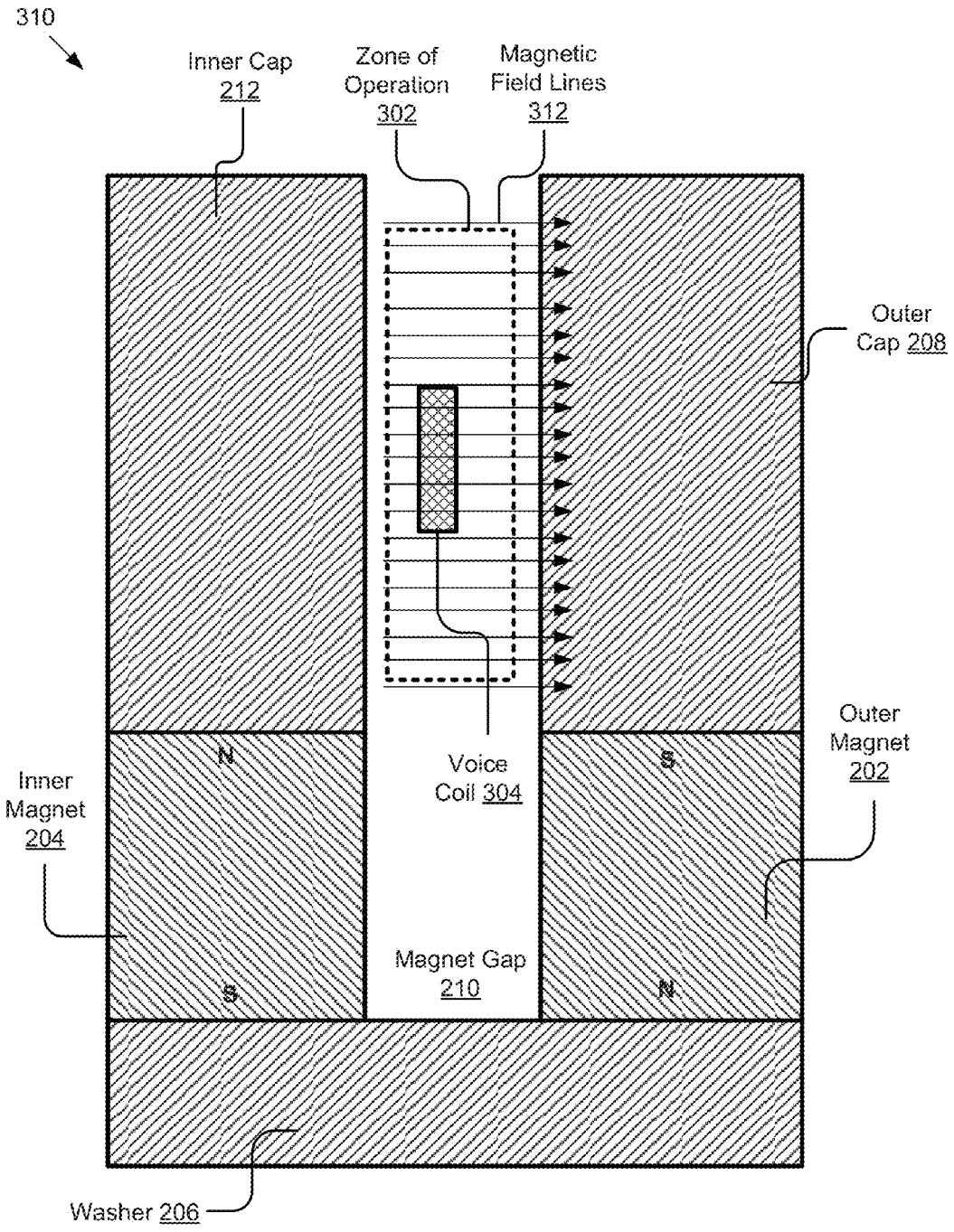
Figure 3C:
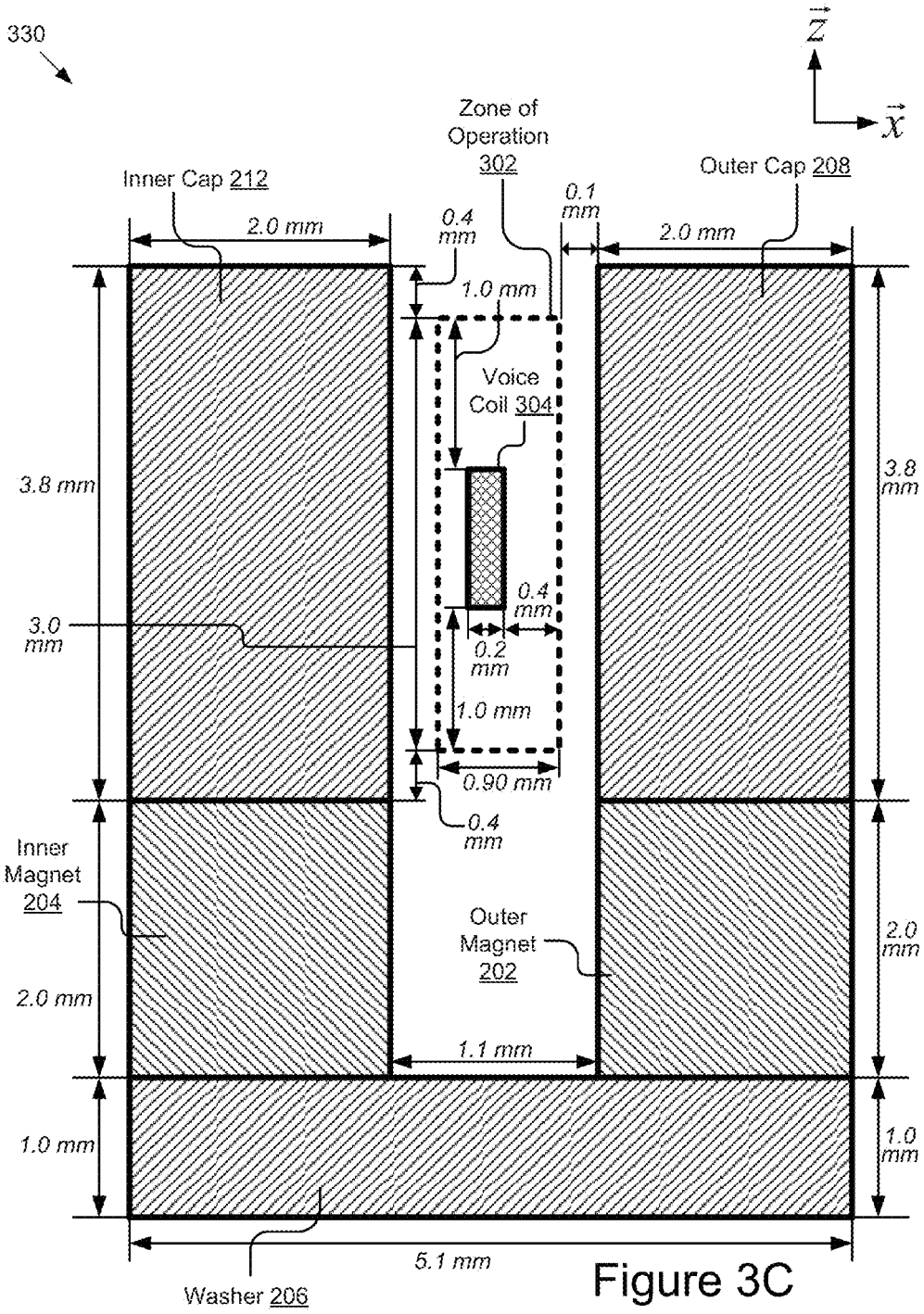

FIGS. 3A-3C are various cross sectional views 300, 310, 330 illustrating an apparatus 200 that includes a magnetic assembly according to various embodiments. Referring now to FIG. 3A, the apparatus 200 additionally includes an electrically-conductive mobile member such as a voice coil 304. The voice coil 304 is coupled to a diaphragm of a driver and disposed in the magnet gap 210 between the inner cap 212 and the outer cap 208. For example, the voice coil 304 is attached or glued to a diaphragm of a driver and disposed in the magnet gap 210 between the inner cap 212 and the outer cap 208. In one embodiment, the voice coil 304 is mechanically coupled to a diaphragm of a driver and disposed in the magnet gap 210 between the inner cap 212 and the outer cap 208. In one embodiment, the voice coil 304 is a four layer coil having 20 turns of wire in each layer. In some embodiments, the voice coil 304 has a height of 1.016 mm and a width (or, a thickness) of 0.2032 mm. In other embodiments, the voice coil 304 may have any number of layers (e.g., one or more layers) and any dimensions (e.g., a width less than or greater than 0.2032 mm, a height less than or greater than 1.016 mm). In one embodiment, the total impedance of the voice coil 304 is approximately 16 ohm. In other embodiments, the total impedance of the voice coil 304 can be less than or greater than 16 ohm. In one embodiment, the coil wire in the voice coil 304 is 45 American Wire Gauge (AWG) with a diameter of 0.0508 mm. Other types of coil wire are possible.

In one embodiment, an ideal motion direction of the voice coil 304 is a direction where the voice coil 304 is intended to move while minimizing distortions in the driver. For example, if the longitudinal axis of the voice coil 304 is axially aligned with the $\vec{z}$ direction as illustrated in FIG. 3A, the ideal motion direction of the voice coil 304 is the $\pm\vec{z}$ direction. In one embodiment, the ideal motion direction of the voice coil 304 is axially aligned with the longitudinal axis of the voice coil 304. In one embodiment, the voice coil 304 is configured to move along an ideal motion direction. For example, the voice coil 304 ideally moves along an ideal motion direction (e.g., $\pm\vec{z}$ direction shown in FIG. 3A) if one or more of the following conditions are satisfied: (1) the magnetic field lines ideally intersect the longitudinal axis of the voice coil 304 at 90 degrees in an excursion range 310 of the voice coil 304; (2) the magnitude of the magnetic field is uniform in the excursion range 310; and (3) there is no misalignment of the voice coil 304.

An excursion range 310 of the voice coil 304 is a range within which the voice coil 304 moves. The excursion range 310 is depicted in FIG. 3A by a dashed line forming a box around the voice coil 304. In one embodiment, the excursion range 310 is a maximum excursion of a driver during a listening process. In one embodiment, the excursion range 310 has a distance of 3.00 mm. For example, the voice coil 304 has a height of 1.00 mm, and is capable to move in the $\vec{z}$ direction with a maximal distance of 1.00 mm, and, in the $-\vec{z}$ direction, with a maximal distance of 1.00 mm from the rest position of the voice coil 304. Accordingly, in this example the excursion range 310 is 3.00 mm [(1.00 mm for the height of the voice coil 304]+(1.00 mm for movement in the $\vec{z}$ direction)+(1.00 mm for movement in the $-\vec{z}$ direction)=3.00 mm]. In other embodiments, the excursion range 310 may have a distance less than or greater than 3.00 mm.

FIG. 3A also illustrates a zone of operation 302 depicted with a dashed line forming a box around the excursion range 310. The zone of operation 302 is an area where the voice coil 304 operates. For example, the zone of operation 302 is an area within the magnet cap 210. In one embodiment, the zone of operation 302 is an area between the inner cap 212 and the outer cap 208 where the voice coil 304 is disposed. The zone of operation 302 includes the excursion range 310. In one embodiment, the zone of operation 302 is an area that is wider than the excursion range 310 along the $\vec{z}$ axis but approximately the same height as the excursion range along the $\vec{z}$ axis. In one embodiment, the zone of operation 302 is wider than the excursion range 310 along the $\vec{x}$ axis because the design of the magnetic assembly is configured to allow the voice coil 304 to be configured anywhere within the magnet gap 310 while minimizing audible distortion as described above with respect to FIGS. 1A through 1J. Accordingly, the design of the magnetic assembly beneficially allows for quality control deficiencies at the time of manufacture. For example, the magnetic assembly can be assembled by configuring the voice coil 304 imperfectly within the magnet gap 210; however, so long as the voice coil 304 is configured within the zone of operation 302 the magnetic assembly can reproduce sound while minimizing audible distortions. In one embodiment, the zone of operation 302 is the entire area of the magnet gap 210. The zone of operation 302 is described below in more detail with reference to FIGS. 3B, 3C, 5A-5C and 6. In one embodiment, the excursion range 310 is any cross section of the zone of operation 302 in which the voice coil 304 moves along the $\vec{z}$ axis.

In one embodiment, the voice coil 304 is different from a traditional voice coil 110. For example, the voice coil 304 has more layers and/or a shorter length when compared to a traditional voice coil 110. The shorter length of the voice coil 304 is beneficial because, for example, it allows the voice coil 304 to be immersed in a magnetic field having substantially uniform magnitude and a direction substantially perpendicular to a longitudinal axis of the voice coil 304 throughout an entire excursion range 310 of the driver. As described below, the direction of the magnetic field within the zone of operation 302 is substantially perpendicular to an ideal motion direction of the voice coil 304 and the zone of operation 302 has substantially uniform magnetic field strength, which enables the voice coil 304 to be more resistant to magnetic field strength variations caused by voice coil misalignment than a traditional voice coil 110.

Referring now to FIG. 3B, one or more magnetic field lines 312 of a magnetic field produced by the magnetic assembly are illustrated. In one embodiment, the outer magnet 202 and the inner magnet 204 are coupled to top of the washer 206 with opposite magnetic polarities. For example, the inner magnet 204 is coupled to the top of the washer 206 with the south pole attached to the washer 206 and the north pole attached to the inner cap 212 while the outer magnet 202 is coupled to the top of the washer 206 with the north pole attached to the washer 206 and the south pole attached to the outer cap 208, so that the magnetic field lines 312 illustrated in FIG. 3B have a direction from the inner cap 212 to the outer cap 208. In another example, the inner magnet 204 is coupled to the top of the washer 206 with the south pole coupled to the inner cap 212 and the north pole coupled to the washer 206 while the outer magnet 202 is coupled to the washer 206 with the north pole coupled to the outer cap 208 and the south pole coupled to the washer 206, so that the magnetic field lines 312 have a direction from the outer cap 208 to the inner cap 212.

Figure 5A:
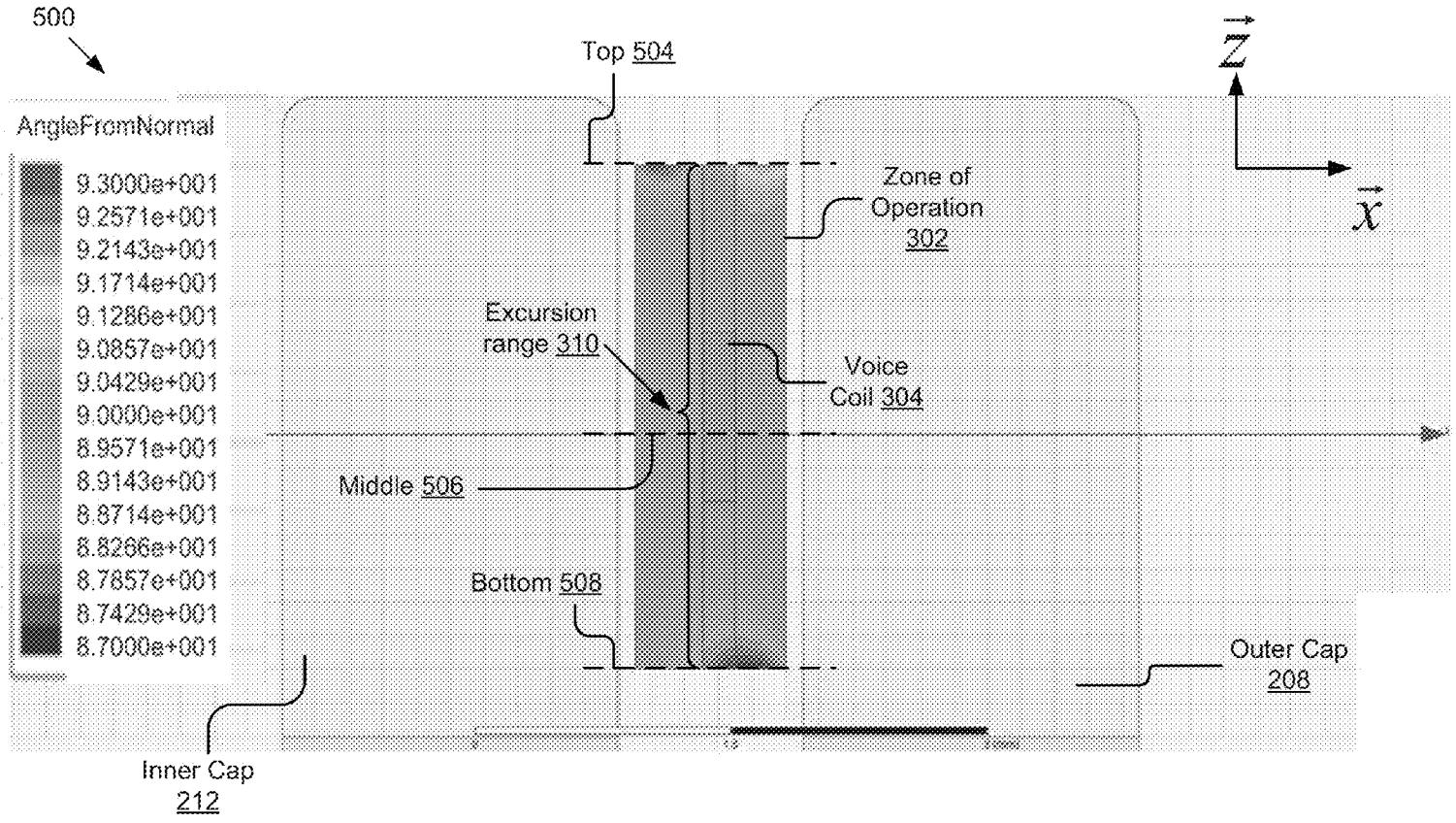
FIG. 5A is a graphical representation illustrating angle variations of magnetic field lines from intersecting a voice coil at 90 degrees in a zone of operation according to one embodiment.

In one embodiment, the direction of the magnetic field (illustrated as direction of the magnetic field lines 312) within the zone of operation 302 is substantially perpendicular to an ideal motion direction of the voice coil 304. For example, the magnetic field lines 312 within the zone of operation 302 are substantially perpendicular to the longitudinal axis of the voice coil 304. In one embodiment, the magnetic field lines 312 in the zone of operation 302 are substantially perpendicular to the ideal motion direction with an angle deviation range between −5 degrees and +5 degrees as illustrated in FIG. 5A. For example, the magnetic field lines 312 in the zone of operation 302 intersect the ideal motion direction at an angle between 85 degrees and 95 degrees.

In one embodiment, at least 99.44% of the zone of operation 302 has magnetic field lines 312 that are substantially perpendicular to the ideal motion direction within an angle deviation range of −3 degrees and +3 degrees. In another embodiment, 99.99% of the zone of operation 302 has magnetic field lines 312 that are substantially perpendicular to the ideal motion direction within an angle deviation range of −3 degrees and +3 degrees. In yet another embodiment, at least 80% of the zone of operation 302 has magnetic field lines 312 whose directions are substantially perpendicular to the ideal motion direction within an angle deviation range of −3 degrees and +3 degrees. In still yet another embodiment, at least 70% of the zone of operation 302 has magnetic field lines whose directions are substantially perpendicular to the ideal motion direction within an angle deviation range of −3 degrees and +3 degrees. In one embodiment, a percentage of the zone of operation 302 that has magnetic field direction substantially perpendicular to the ideal motion direction within an angle deviation range of −3 degrees and +3 degrees is between 70% and 99.99%.

In one embodiment, at least 97% of the zone of operation 302 has magnetic field lines 312 that are substantially perpendicular to the ideal motion direction within an angle deviation range of −2 degrees and +2 degrees. In another embodiment, 99.99% of the zone of operation 302 has magnetic field lines 312 that are substantially perpendicular to the ideal motion direction within an angle deviation range of −2 degrees and +2 degrees. In yet another embodiment, at least 75% of the zone of operation 302 has magnetic field lines 312 whose directions are substantially perpendicular to the ideal motion direction within an angle deviation range of −2 degrees and +2 degrees. In still yet another embodiment, at least 65% of the zone of operation 302 has magnetic field lines whose directions are substantially perpendicular to the ideal motion direction within an angle deviation range of −2 degrees and +degrees. In one embodiment, a percentage of the zone of operation 302 that has magnetic field direction substantially perpendicular to the ideal motion direction within an angle deviation range of −2 degrees and +degrees is between 65% and 99.99%.

In one embodiment, the zone of operation 302 has substantially uniform magnetic field strength. For example, the magnitude of the magnetic field in the zone of operation 302 varies by less than 16.5% from a nominal value of the magnetic field. In another example, the magnitude of the magnetic field in the zone of operation 302 varies by less than 30% from a nominal value of the magnetic field. A nominal value of the magnetic field is a value for the magnitude of the magnetic field at the center point of the voice coil 304 when the voice coil 304 is at its rest position (e.g., a nominal value is a magnitude value of the magnetic field at the center point of the box 304 representing the voice coil 304 when the voice coil 304 is at its rest position without any movement). The nominal value of the magnetic field is further illustrated in FIG. 7A. In one embodiment, the magnitude of the magnetic field within the excursion range 310 of the voice coil 304 varies by less than 6% from the nominal value of the magnetic field. In another embodiment, the magnitude of the magnetic field within the excursion range 310 of the voice coil 304 varies by less than 20% from the nominal value of the magnetic field.

Referring now to FIG. 3C, example dimensions for components of the apparatus 200 are provided according to one embodiment. In the illustrated embodiment, the inner cap 212 and the outer cap 208 each have a width of 2.0 mm and a height of 3.8 mm. The inner magnet 204 and the outer magnet 202 each have a width of 2.0 mm and a height of 2.0 mm. In one embodiment, the inner magnet 204 and the outer magnet 202 each have a width between 2.00 mm and 4.00 mm. The distance between the inner magnet 204 and the outer magnet 202 is 1.1 mm. The washer 206 has a width of 5.1 mm and a height of 1.0 mm. In other embodiments, a width of the inner cap 212, the outer cap 208, the inner magnet 204, the outer magnet 202 and/or the washer 206 can be between 0.1 mm and 100 mm; a height of the inner cap 212, the outer cap 208, the inner magnet 204, the outer magnet 202 and/or the washer 206 can be between 0.1 mm and 100 mm; and a distance between the inner magnet 204 and/or the outer magnet 202 can be between 0.1 mm and 100 mm. In one embodiment, the above-described example dimensions for components of the apparatus are beneficial because they provide a zone of operation 302 that minimizes audio distortion.

In the illustrated embodiment, the zone of operation 302 has a width of 0.90 mm and a height of 3.0 mm. The distance between the top of the zone of operation 302 and the top of the voice coil 304 is 1.0 mm. The distance between the bottom of the zone of operation 302 and the bottom of the voice coil 304 is 1.0 mm. For example, the height of the zone of operation 302 is configured to allow the voice coil 304 to travel a maximal distance of 1.00 mm in either the $+\vec{z}$ direction or the $-\vec{z}$ direction from the rest position of the voice coil 304 with substantially uniform magnetic field during the travel process. The width of the zone of operation 302 is configured to minimize defect rate and influence of voice coil misalignment on the acoustic performance of the driver even if the voice coil 304 is misaligned or disposed off-center.

In the illustrated embodiment, the distance between the top of the inner cap 212 and the top of the zone of operation 302 is 0.4 mm. The distance between the bottom of the inner cap 212 and the bottom of the zone of operation 302 is 0.4 mm. The distance between the inner cap 212 and the zone of operation 302 is 0.1 mm. The distance between the outer cap 208 and the zone of operation 302 is 0.1 mm. The distance between the left edge of the zone of operation 302 and the voice coil 304 is 0.3 mm. The distance between the right edge of the zone of operation 302 and the voice coil 304 is 0.4 mm. The voice coil 304 has a width of 0.2 mm and a height of 1.0 mm.

In other embodiments, the components of the apparatus 200 (e.g., the inner cap 212, the outer cap 208, the inner magnet 204, the outer magnet 202, the washer 206, the voice coil 304, etc.) may have other dimensions. For example, the inner cap 212 and the outer cap 208 may have a width greater than or less than 2.0 mm and/or a height greater than or less than 3.8 mm; the inner magnet 204 and the outer magnet 202 each may have a width greater than or less than 2.0 mm and/or a height greater than or less than 2.0 mm; the washer 206 may have a width greater than or less than 5.1 mm and/or a height greater than or less than 1.0 mm; and the voice coil 304 may have a width greater than or less than 0.2 mm and/or a height greater than or less than 1.0 mm. The zone of operation 302 may have a width greater than or less than 0.90 mm and/or a height greater than or less than 3.00 mm.

Graphical Representations

Figure 4:
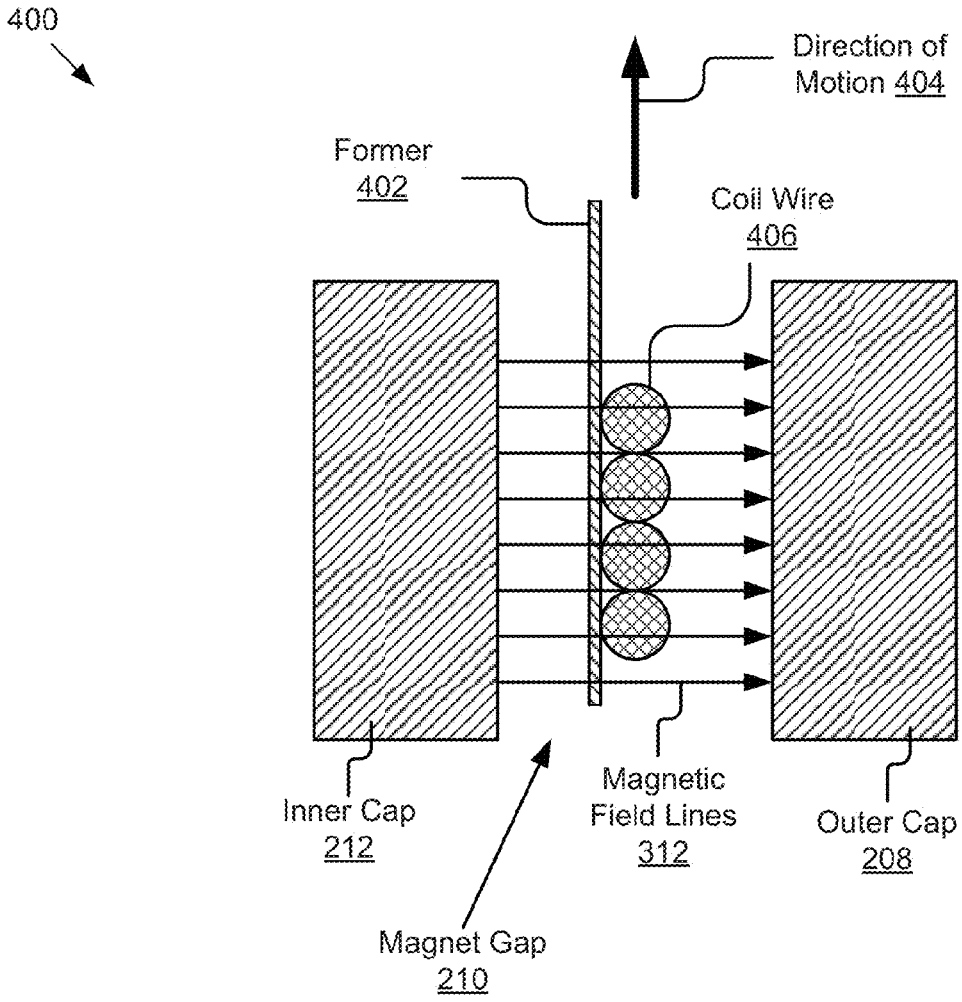
FIG. 4 is a graphical representation illustrating an example direction of motion for a voice coil according to one embodiment.

FIG. 4 is a graphical representation 400 illustrating a direction of motion 404 for a voice coil 304 according to one embodiment. The voice coil 304 includes one or more coil wires 406 wound around the former 402. As illustrated in FIG. 4, the magnetic field lines 312 are substantially perpendicular to the longitudinal axis of the voice coil 304 (or, an ideal motion direction of the voice coil 304). The electrical current passes through the coil wires 406 in a direction pointing out of the page (e.g., pointing towards a user viewing the figure) and a force is generated having a direction perpendicular to the current and the magnetic field lines 312 according to the right-hand rule. Because the magnetic field lines 312 are substantially perpendicular to the longitudinal axis of the voice coil 304, the generated force is substantially aligned with the ideal motion direction of the voice coil 304, causing the direction of motion 404 of the voice coil 304 substantially aligned with the ideal motion direction of the voice coil 304.

FIG. 5A is a graphical representation 500 illustrating angle variations of magnetic field lines from intersecting the longitudinal axis of the voice coil 304 at 90 degrees within the zone of operation 302 according to one embodiment. In the illustrated embodiment, the longitudinal axis of the voice coil 304 is axially aligned with the $\vec{z}$ component and the ideal motion direction of the voice coil 304 is also axially aligned with the $\vec{z}$ component. For example, the ideal motion direction of the voice coil 304 is $\vec{z}$ direction or $-\vec{z}$ direction. The magnetic field lines within the zone of operation 302 are substantially perpendicular to the ideal motion direction of the voice coil 304. For example, the magnetic field lines in the zone of operation 302 intersect the ideal motion direction at 90 degrees within a deviation range between −5 degrees and +5 degrees. In one embodiment, the magnetic field lines in the zone of operation 302 intersect the ideal motion direction at 90 degrees within a deviation range between −3 degrees and +3 degrees.

Figure 6:
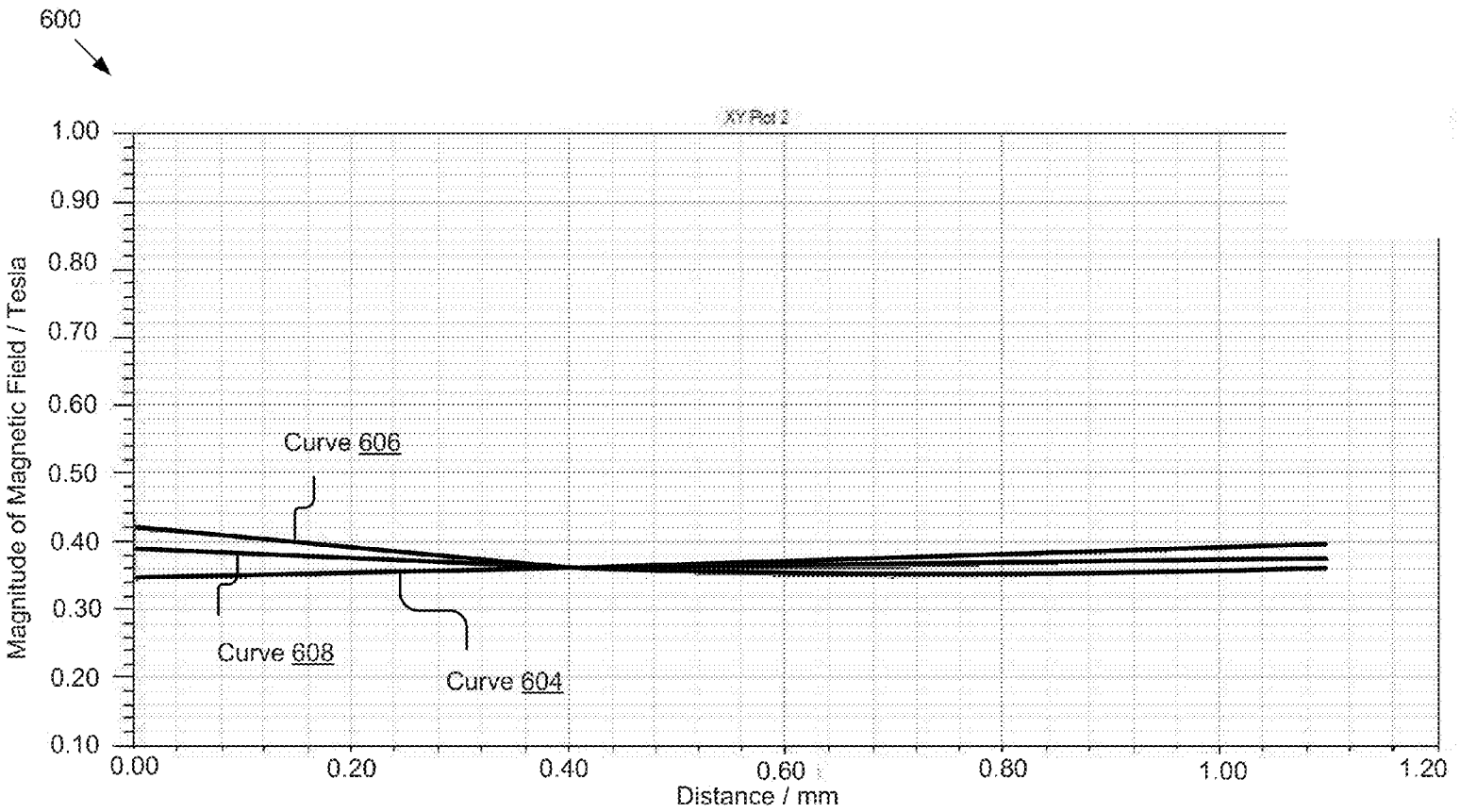
FIG. 6 is a graphical representation illustrating magnitude of magnetic field in various locations in a zone of operation according to one embodiment.

The graphical representation 500 also illustrates of an excursion range 310 for the voice coil 304 according to one embodiment. The excursion range 310 is within the zone of operation 302. The magnetic field lines within the excursion range 310 are substantially perpendicular to the ideal motion direction of the voice coil 304 and the magnetic flux density (or, the magnitude of the magnetic field) in the excursion range 310 is substantially uniform. For example, the magnitude of the magnetic field within the excursion range 310 varies by less than 6% from a nominal value of the magnetic field. A top 504, a middle 506 and a bottom 508 of the zone of operation 302 are illustrated in FIG. 5A, and the magnitude of the magnetic field at these locations is illustrated in FIG. 6 respectively.

Figure 5B:
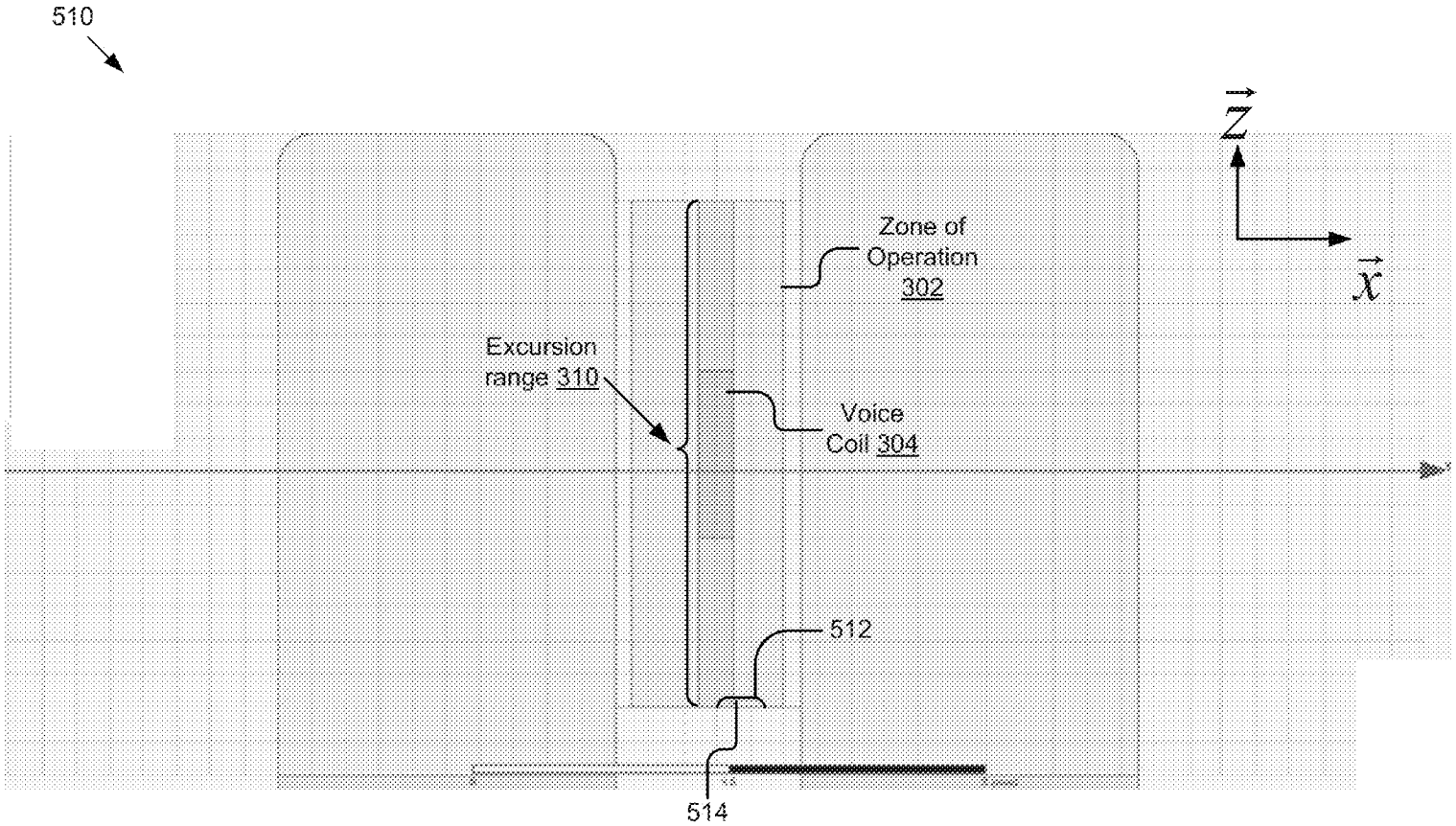
FIG. 5B is a graphical representation illustrating a contour plot of a boundary where the direction of magnetic field has a deviation of ±3 degrees from a direction perpendicular to a longitudinal axis of a voice coil in a zone of operation according to one embodiment.

FIG. 5B is a graphical representation 510 illustrating a contour plot of a boundary 512 where the direction of magnetic field has a deviation of ±3 degrees from a direction that is perpendicular to the ideal motion direction of the voice coil 304 within the zone of operation 302 according to one embodiment. The contour plot in FIG. 5B is obtained based at least in part on FIG. 5A. For example, the magnetic field lines at the boundary 512 intersect the longitudinal axis of the voice coil 304 at 87 degrees (a deviation of −3 degrees from 90 degrees). The area 514 within the zone of operation 302 is an area surrounding by the boundary 512 to the bottom of the zone of the operation 302. The area 514 has magnetic field lines intersecting the longitudinal axis of the voice coil 304 at an angle with a deviation greater than ±3 degrees from 90 degrees. However, a remaining portion of the zone of the operation 302 (the zone of operation 302 minus the area 514) has magnetic field lines intersecting the longitudinal axis of the voice coil 304 at an angle with a deviation less than ±3 degrees from 90 degrees.

Figure 5C:
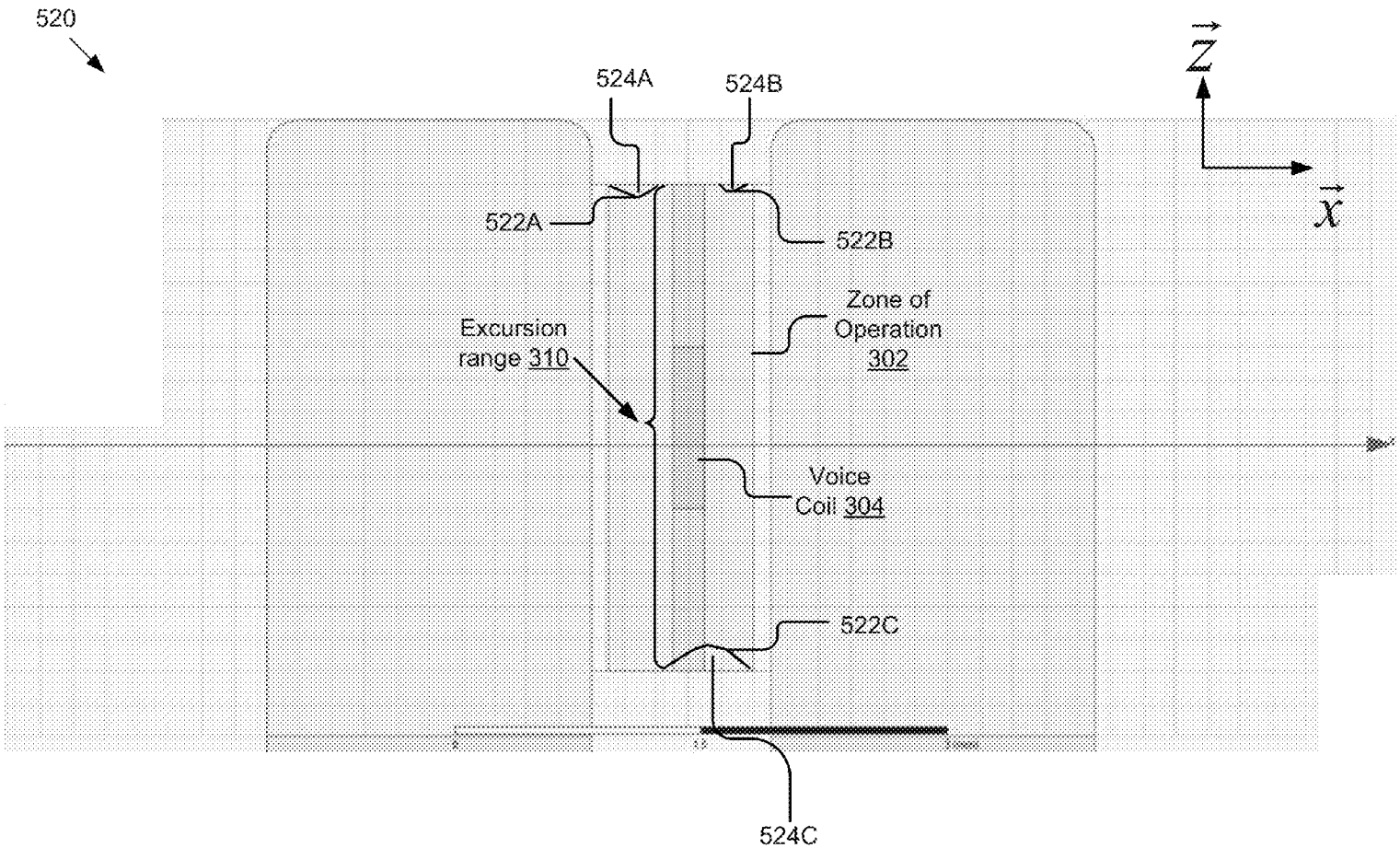
FIG. 5C is a graphical representation illustrating a contour plot of boundaries where the direction of the magnetic field has a deviation of ±2 degrees from a direction perpendicular to a longitudinal axis of a voice coil in a zone of operation according to one embodiment.

FIG. 5C is a graphical representation 520 illustrating a contour plot of boundaries 522A, 522B, 522C where the direction of the magnetic field has a deviation of ±2 degrees from a direction perpendicular to the ideal motion direction of the voice coil 304 in the zone of operation 302 according to one embodiment. The contour plot in FIG. 5C is obtained based at least in part on FIG. 5A. For example, the magnetic field lines at the boundary 522A intersect the longitudinal axis of the voice coil 304 at 88 degrees (a deviation of −2 degrees from 90 degrees); the magnetic field lines at the boundary 522B intersect the longitudinal axis of the voice coil 304 at 92 degrees (a deviation of +2 degrees from 90 degrees); and the magnetic field lines at the boundary 522C intersect the longitudinal axis of the voice coil 304 at 88 degrees (a deviation of −2 degrees from 90 degrees).

The area 524A within the zone of operation 302 is an area from the boundary 522A to the top of the zone of the operation 302. The area 524B within the zone of operation 302 is an area from the boundary 522B to the top of the zone of the operation 302. The area 524C within the zone of operation 302 is an area from the boundary 522C to the bottom of the zone of the operation 302. The areas 524A, 524B and 524C have magnetic field lines intersecting the longitudinal axis of the voice coil 304 at an angle with a deviation greater than ±2 degrees from 90 degrees. However, a remaining portion of the zone of the operation 302 (the zone of operation 302 minus the areas 524A, 524B, 524C) has magnetic field lines intersecting the longitudinal axis of the voice coil 304 at an angle with a deviation less than ±2 degrees from 90 degrees.

FIG. 6 is a graphical representation 600 illustrating magnitude of magnetic field (or, magnetic flux density) in various locations of the zone of operation 302 according to one embodiment. The horizontal axis indicates a distance from the inner cap 212 to the outer cap 208. A curve 608 illustrates the magnitude of the magnetic field distributed at different distances from the inner cap 212 to the outer cap 208 along the bottom 508 of the zone of operation 302. A curve 606 illustrates the magnitude of the magnetic field distributed at different distances from the inner cap 212 to the outer cap 208 along the middle 506 of the zone of operation 302. A curve 604 illustrates the magnitude of the magnetic field distributed at different distances from the inner cap 212 to the outer cap 208 along the top 504 of the zone of operation 302. The curves 604, 606 and 608 indicate that the magnitude of the magnetic field in the zone of operation 302 is substantially uniform.

FIGS. 7A-7G are graphical representations 700, 710, 720, 730, 740, 750, 760 illustrating movement of the voice coil 304 at different sample times according to one embodiment. In the depicted embodiment graphical representations 700, 710, 720, 730, 740, 750, 760 are chronologically sequenced so that graphical representation 700 occurs first in time in the sequence and graphical representation 760 occurs last in time in the sequence. Accordingly, graphical element 700 occurs first in time relative to graphical element 710, graphical element 710 occurs earlier in time relative to graphical element 720, graphical element 720 occurs earlier in time relative to graphical element 730, graphical element 730 occurs earlier in time relative to graphical element 740, graphical element 740 occurs earlier in time relative to graphical element 750, graphical element 750 occurs earlier in time relative to graphical element 760. Graphical element 760 occurs last in time relative to the other graphical elements 700, 710, 720, 730, 740, 750.

Figure 7A:
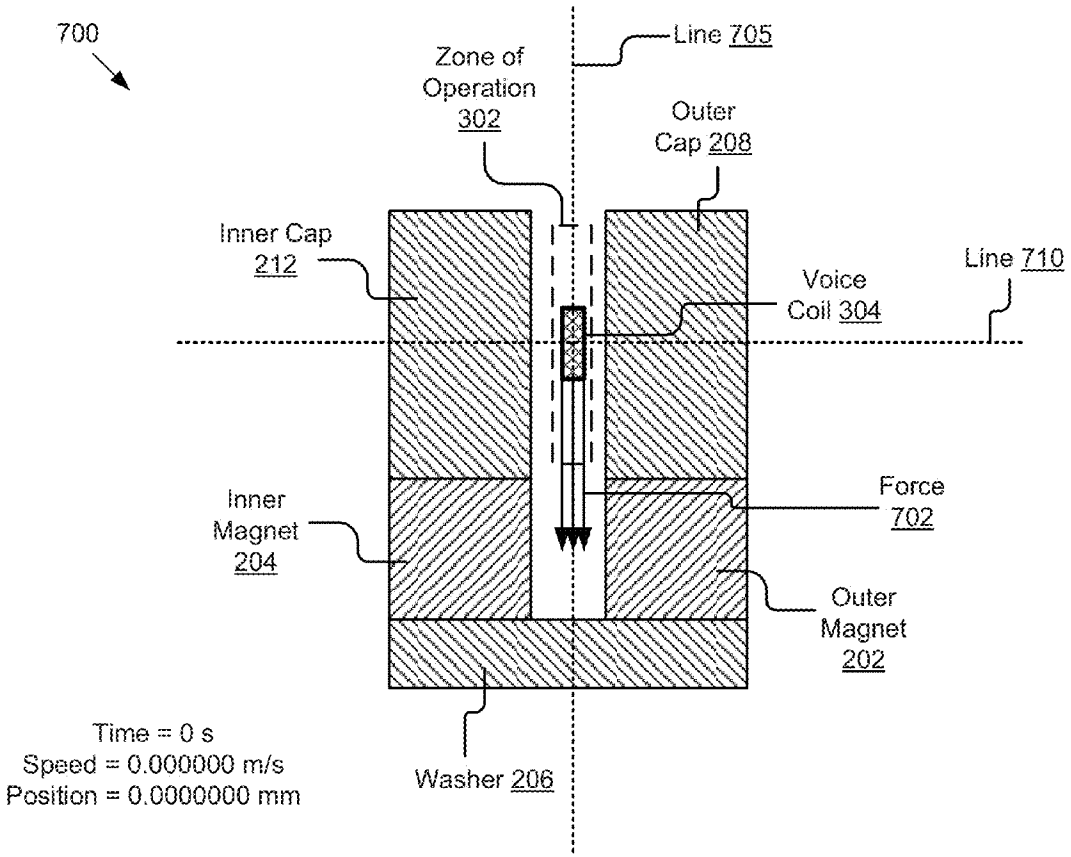
FIGS. 7A-7G are graphical representations illustrating movement of a voice coil in different sample times according to one embodiment.

Referring now to FIG. 7A, the sample time is zero second. Line 710 indicates a center position line of the voice coil 304 when the voice coil 304 is stationary or at rest. Line 705 is axially aligned with the longitudinal axis of the voice coil 304 and intersects the line 710 orthogonally at the center point of the box 304 representing the voice coil 304. A nominal value of the magnetic field is a magnitude value of the magnetic field at the center point of the box 304 where lines 705 and 710 intersects with each other. The voice coil 304 is stationary with zero speed and the center of the voice coil 304 is at a position of zero mm from line 710. When an alternating current is applied to the voice coil 304, Lorentz forces 702 are generated and act on the voice coil 304, causing the voice coil 304 to move up and down within the zone of operation 302.

In the illustrated embodiment, assume the magnetic field within the zone of operation 302 has a direction from the inner cap 212 to the outer cap 208 and the alternating current has a direction pointing inwards to the paper. According to the right hand rule, the generated forces 702 have a direction perpendicular to the direction of the magnetic field and the alternating current. In the illustrated embodiment, the forces 702 have a direction pointing towards the washer 206 which is substantially parallel with an ideal motion direction of the voice coil 304. Because the forces 702 act on the voice coil 304, the voice coil 304 starts to move down in a direction substantially parallel with the ideal motion direction.

Figure 7B:
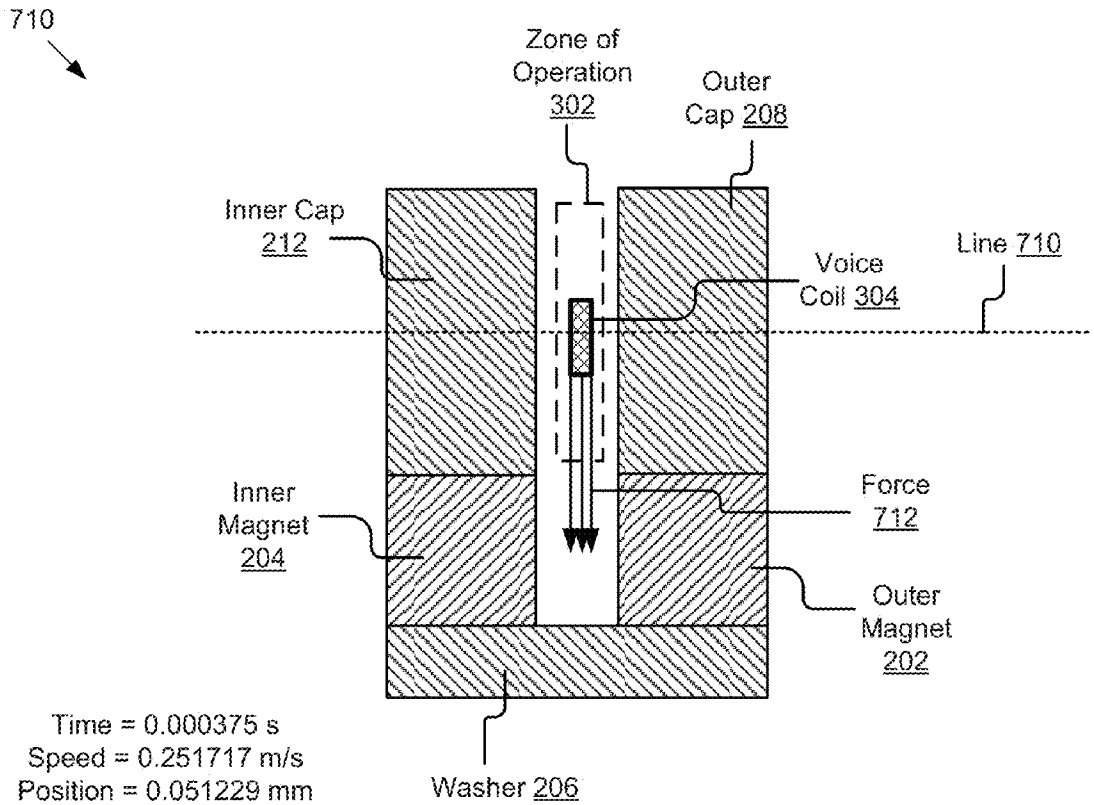

Referring now to FIG. 7B, the sample time is 0.000375 second. The voice coil 304 has a speed of 0.251717 meter/second (m/s) moving down towards the washer 206. The center of the voice coil 304 is at a position of 0.051229 mm below line 710. In the illustrated embodiment, the generated forces 712 have a direction pointing towards the washer 206 which is substantially parallel with the ideal motion direction of the voice coil 304. Because the forces 712 acting on the voice coil 304 have the same direction as the movement of the voice coil 304, the movement of the voice coil 304 accelerates towards the washer 206.

Figure 7C:
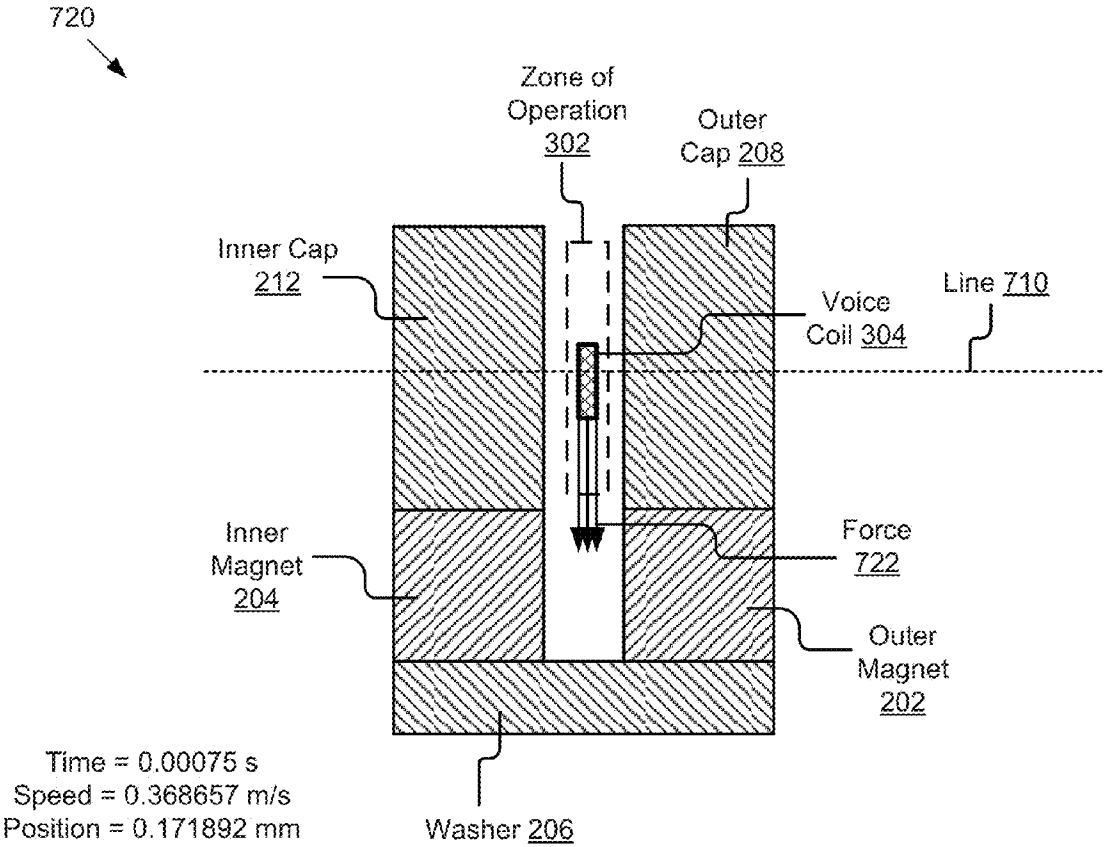

Referring now to FIG. 7C, the sample time is 0.00075 second. The voice coil 304 has a speed of 0.368657 m/s moving down towards the washer 206. The center of the voice coil 304 is at a position of 0.171892 mm below line 710. In the illustrated embodiment, the generated forces 722 acting on the voice coil 304 have a direction pointing towards the washer 206 which is substantially parallel with the ideal motion direction of the voice coil 304.

Figure 7D:
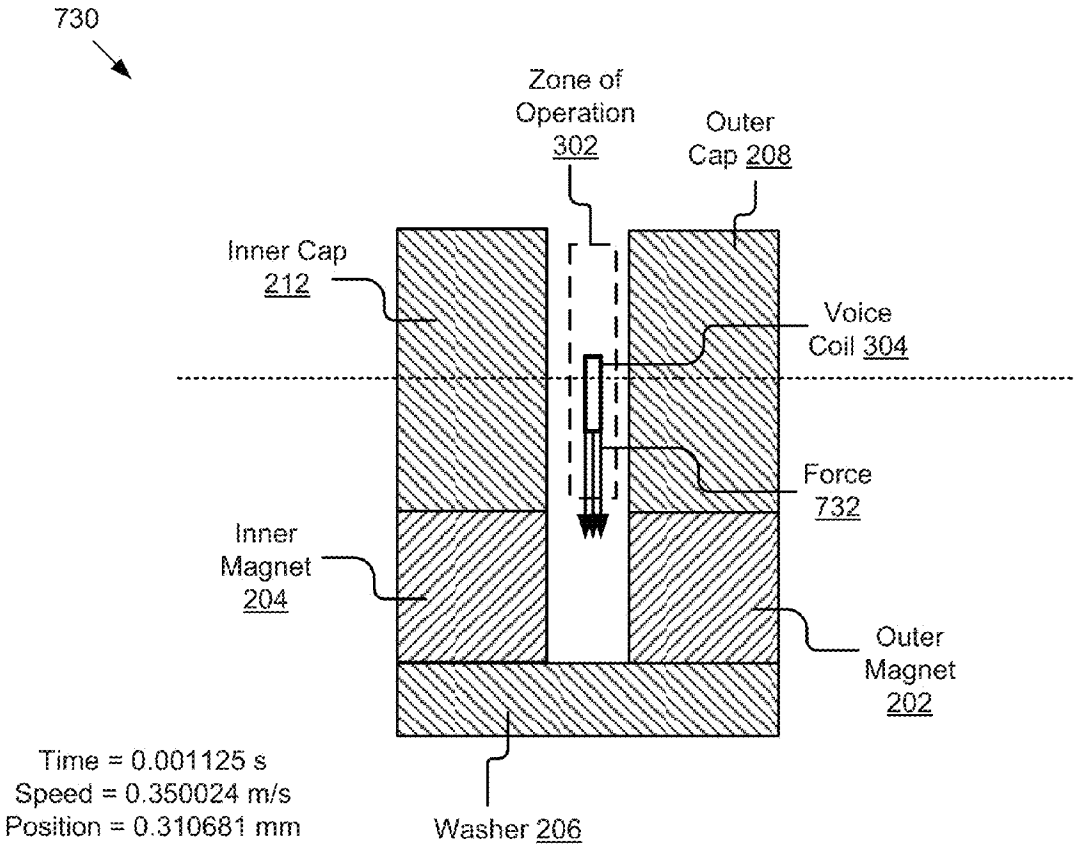

Referring now to FIG. 7D, the sample time is 0.001125 second. The voice coil 304 has a speed of 0.350024 m/s moving down towards the washer 206. The center of the voice coil 304 is at a position of 0.310681 mm below line 710. The forces 732 have a direction pointing towards the washer 206 which is substantially parallel with an ideal motion direction of the voice coil 304.

Figure 7E:
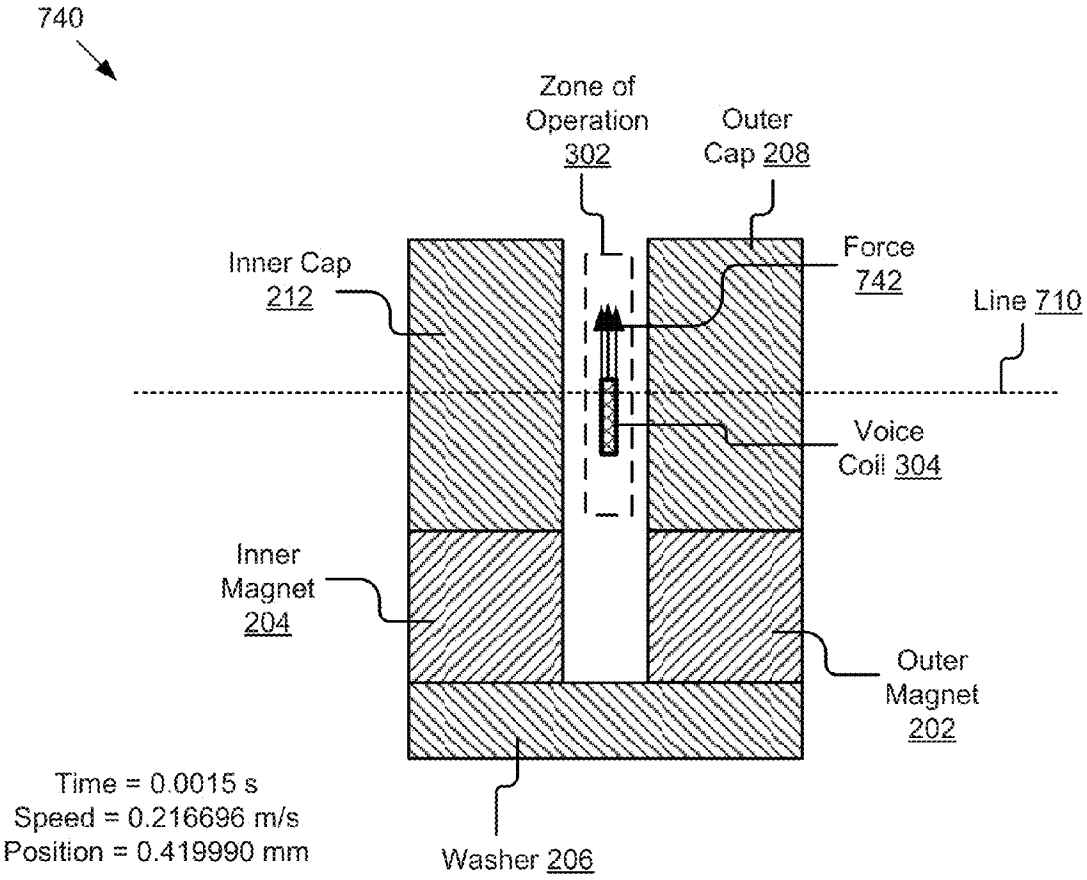

Referring now to FIG. 7E, the sample time is 0.0015 second. The voice coil 304 has a speed of 0.216696 m/s moving down towards the washer 206. The center of the voice coil 304 is at a position of 0.419990 mm below line 710. In the illustrated embodiment, because the alternating current changes its direction from pointing inwards to the paper to pointing outwards from the paper, the generated forces 742 has a different direction from the forces 702, 712 and 722. In the illustrated embodiment, the forces 742 have a direction pointing upwards which is substantially parallel with an ideal motion direction of the voice coil 304. Because the forces 742 acting on the voice coil 304 have an opposite direction from the movement of the voice coil 304, the movement of the voice coil 304 decelerates towards the washer 206.

Figure 7F:
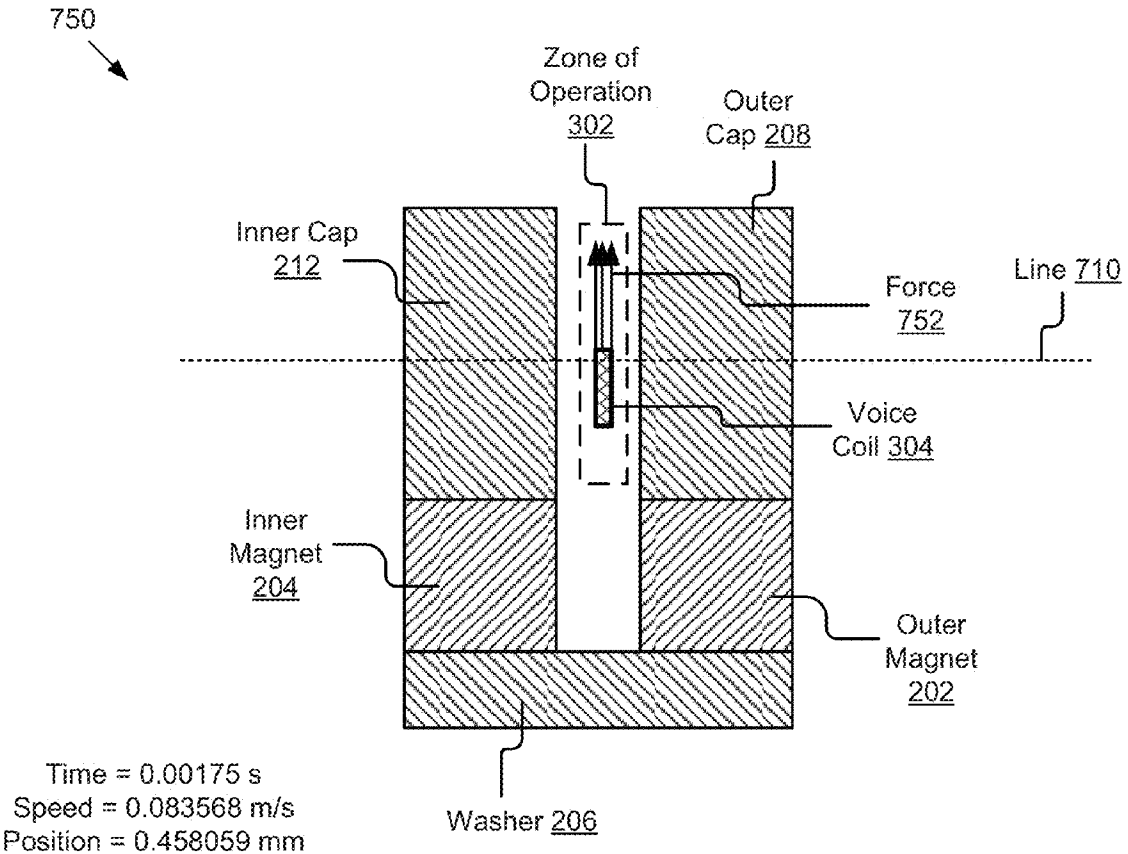

Referring now to FIG. 7F, the sample time is 0.00175 second. The voice coil 304 has a speed of 0.083568 m/s moving towards the washer 206. The center of the voice coil 304 is at a position of 0.458059 mm below line 710. In the illustrated embodiment, the generated forces 752 have a direction pointing upwards which is substantially parallel with the ideal motion direction of the voice coil 304. Because the forces 752 acting on the voice coil 304 have an opposite direction from the movement of the voice coil 304, the movement of the voice coil 304 decelerates towards the washer 206.

Figure 7G:
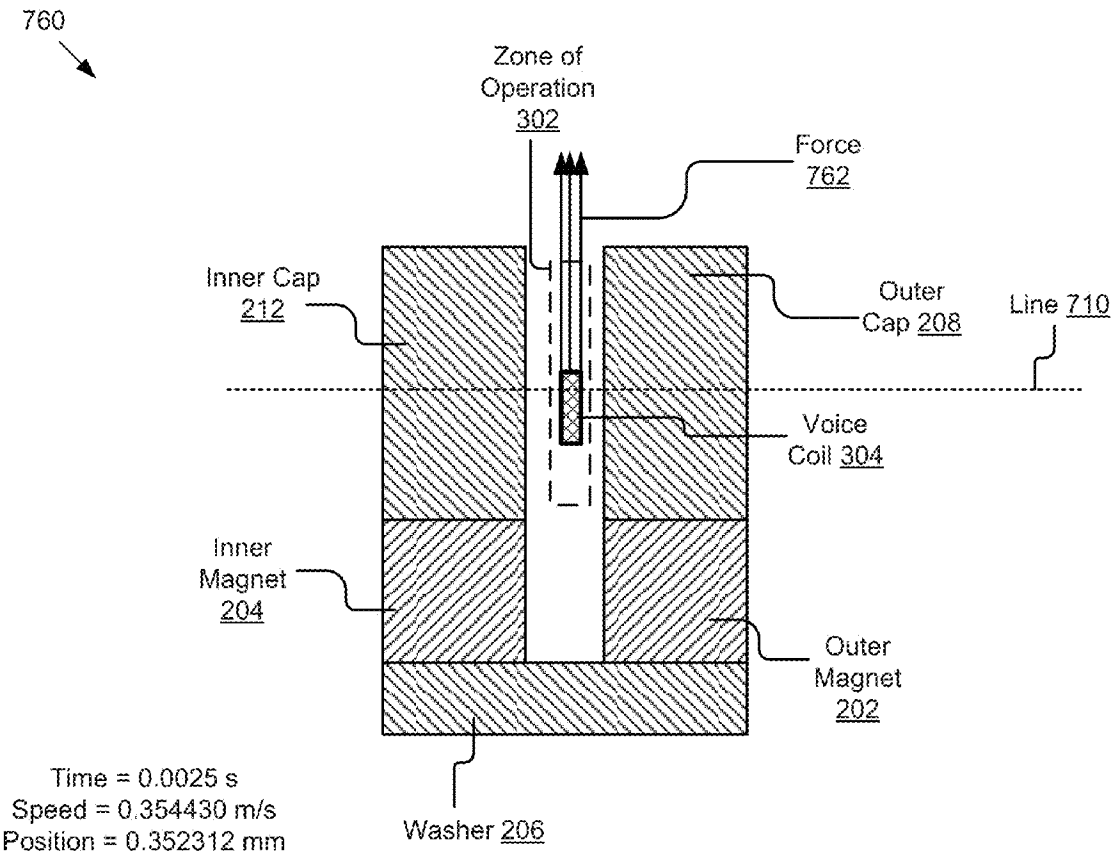

Referring now to FIG. 7G, the sample time is 0.0025 second. The voice coil 304 has a speed of 0.354430 m/s moving upwards. The center of the voice coil 304 is at a position of 0.352312 mm below line 710. In the illustrated embodiment, the generated forces 762 have a direction pointing upwards which is substantially parallel with the ideal motion direction of the voice coil 304. Because the forces 762 acting on the voice coil 304 have the same direction as the movement of the voice coil 304, the voice coil 304 accelerates moving upwards.

The foregoing description of the embodiments has been presented for the purposes of illustration and description. It is not intended to be exhaustive or to limit the specification to the precise form disclosed. Many modifications and variations are possible in light of the above teaching. It is intended that the scope of the embodiments be limited not by this detailed description, but rather by the claims of this application. As will be understood by those familiar with the art, the examples may be embodied in other specific forms without departing from the spirit or essential characteristics thereof. Likewise, the particular naming and division of the modules, routines, features, attributes, methodologies and other aspects are not mandatory or significant, and the mechanisms that implement the description or its features may have different names, divisions and/or formats. Furthermore, as will be apparent to one of ordinary skill in the relevant art, the modules, routines, features, attributes, methodologies and other aspects of the specification can be implemented as software, hardware, firmware or any combination of the three. Accordingly, the disclosure is intended to be illustrative, but not limiting, of the scope of the specification, which is set forth in the following claims.

What is claimed is:

1. An apparatus comprising:

a magnetic assembly including a ring-shaped inner magnet, a ring-shaped outer magnet, a ring-shaped inner cap, a ring-shaped outer cap and a ring-shaped washer, the inner magnet and the outer magnet concentrically mounted on top of the washer with opposite magnetic polarities, the inner cap mounted on top of the inner magnet, the outer cap mounted on top of the outer magnet, the magnetic assembly configured to produce a magnetic field having a zone of operation between the inner cap and the outer cap, the zone of operation having magnetic field lines substantially perpendicular to an ideal motion direction, the zone of operation having substantially uniform magnetic field strength, the zone of operation having a width of 0.90 millimeters and a height of 3.00 millimeters, the inner magnet and the outer magnet each having a width of 2.00 millimeters and a height of 2.00 millimeters, the inner cap and the outer cap each having a width of 2.00 millimeters and a height of 3.80 millimeters, the washer having a width of 5.10 millimeters and a height of 1.00 millimeter; and a voice coil disposed in the zone of operation of the magnetic field and mechanically coupled to a diaphragm of a driver, the voice coil being a four-layer coil with each layer having twenty turns of wire, the voice coil having a maximal width of 0.2032 millimeters and a height of 1.016 millimeters, the voice coil configured to move within the zone of operation of the magnetic field when an alternating current passes through the voice coil, the ideal motion direction axially aligned with a longitudinal axis of the voice coil.

2. An apparatus comprising:

a magnetic assembly including an inner magnet, an outer magnet, an inner cap, an outer cap and a washer, the magnetic assembly configured to produce a magnetic field having a zone of operation between the inner cap and the outer cap, the zone of operation having substantially uniform magnetic field strength, the zone of operation having magnetic field directions substantially perpendicular to an ideal motion direction, a first distance between the inner cap and the zone of operation configured to be 0.10 millimeters, a second distance between a bottom of the inner cap and a bottom of the zone of operation configured to be 0.40 millimeters; and an electrically-conductive mobile member disposed in the zone of operation of the magnetic field and mechanically coupled to a diaphragm of a driver, the electrically-conductive mobile member configured to move within the zone of operation of the magnetic field in response to the magnetic field when an alternating current is passed through the electrically-conductive mobile member.

3. The apparatus of claim 2, wherein:

the inner magnet and the outer magnet are mounted on top of the washer with opposite magnetic polarities;

the inner cap is mounted on top of the inner magnet; and the outer cap is mounted on top of the outer magnet.

4. The apparatus of claim 3, wherein:

the washer, the inner magnet, the outer magnet, the inner cap and the outer cap are ring-shaped;

an inner diameter of the outer magnet is greater than an outer diameter of the inner magnet; and the inner magnet and the outer magnet are concentrically mounted on top of the washer.

5. The apparatus of claim 2, wherein magnetic field lines in the zone of operation intersect the ideal motion direction at 90 degrees within a deviation range between −3 degrees and +3 degrees.

6. The apparatus of claim 2, wherein the ideal motion direction is axially aligned with a longitudinal axis of the electrically-conductive mobile member.

7. The apparatus of claim 2, wherein at least 99.44% of the zone of operation has magnetic field lines intersecting the ideal motion direction at 90 degrees within a deviation range between −3 degrees and +3 degrees.

8. The apparatus of claim 2, wherein at least 97% of the zone of operation has magnetic field lines intersecting the ideal motion direction at 90 degrees within a deviation range between −2 degrees and +2 degrees.

9. The apparatus of claim 2, wherein magnitude of the magnetic field in the zone of operation varies by less than 16.5% from a nominal value of the magnetic field.

10. The apparatus of claim 9, wherein the nominal value of the magnetic field is a magnitude value of the magnetic field at a center point of the electrically-conductive mobile member when the electrically-conductive mobile member is at a rest position.

11. The apparatus of claim 2, wherein the zone of operation includes an excursion range of the electrically-conductive mobile member.

12. The apparatus of claim 11, wherein magnitude of the magnetic field within the excursion range varies by less than 6% from a nominal value of the magnetic field.

13. The apparatus of claim 2, wherein the electrically-conductive mobile member is a voice coil.

14. The apparatus of claim 13, wherein the voice coil is a four layer coil.

15. The apparatus of claim 13, wherein the voice coil has an impedance of 16 ohm.

16. The apparatus of claim 2, wherein the zone of operation has a width of 0.90 millimeter and a height of 3.00 millimeters.

17. The apparatus of claim 2, wherein:

the inner magnet and the outer magnet have a width of 2.00 millimeters and a height of 2.00 millimeters;

the inner cap and the outer cap have a width of 2.00 millimeters and a height of 3.8 millimeters; and the washer has a width of 5.10 millimeters and a height of 1.00 millimeter.

18. The apparatus of claim 2, wherein one or more forces that are applied to the electrically-conductive mobile member when the alternating current passes through the electrically-conductive mobile member are substantially axially aligned with the ideal motion direction.

19. An apparatus comprising:

a magnetic assembly including a disc-shaped inner magnet, a ring-shaped outer magnet, a disc-shaped inner cap, a ring-shaped outer cap and a disc-shaped washer, the inner magnet and the outer magnet concentrically mounted on top of the washer with opposite magnetic polarities, the inner cap mounted on top of the inner magnet, the outer cap mounted on top of the outer magnet, the magnetic assembly configured to produce a magnetic field having a zone of operation between the inner cap and the outer cap, the zone of operation having magnetic field lines substantially perpendicular to an ideal motion direction, the zone of operation having substantially uniform magnetic field strength, the zone of operation having a width of 0.90 millimeters and a height of 3.00 millimeters, the inner magnet having a height of 2.00 millimeters, the outer magnet having a width of 2.00 millimeters and a height of 2.00 millimeters, the inner cap having a height of 3.80 millimeters, the outer cap having a width of 2.00 millimeters and a height of 3.80 millimeters; and a voice coil disposed in the zone of operation of the magnetic field and mechanically coupled to a diaphragm of a driver, the voice coil being a four-layer coil with each layer having twenty turns of wire, the voice coil having a maximal width of 0.2032 millimeters and a height of 1.016 millimeters, the voice coil configured to move within the zone of operation of the magnetic field when an alternating current passes through the voice coil, the ideal motion direction axially aligned with a longitudinal axis of the voice coil.

* * * * *